US012048327B2

(12) United States Patent
Mason et al.

(10) Patent No.: US 12,048,327 B2
(45) Date of Patent: Jul. 30, 2024

(54) AEROSOL GENERATION DEVICE WITH CLOSURE

(71) Applicant: JT International S.A., Geneva (CH)

(72) Inventors: Jon Mason, London (GB); Nathan Lyell, Woking (GB); Marko Plevnik, London (GB)

(73) Assignee: JT International S.A. (CH)

( * ) Notice: Subject to any disclaimer, the term of this patent is extended or adjusted under 35 U.S.C. 154(b) by 357 days.

(21) Appl. No.: 17/602,089

(22) PCT Filed: Apr. 30, 2020

(86) PCT No.: PCT/EP2020/062065

§ 371 (c)(1),
(2) Date: Oct. 7, 2021

(87) PCT Pub. No.: WO2020/225102

PCT Pub. Date: Nov. 12, 2020

(65) Prior Publication Data

US 2022/0142247 A1 May 12, 2022

(30) Foreign Application Priority Data

May 3, 2019 (EP) ..... 19172662
Aug. 16, 2019 (EP) ..... 19192164

(51) Int. Cl.
*A24F 40/40* (2020.01)
*A24F 40/20* (2020.01)
*A24F 40/51* (2020.01)

(52) U.S. Cl.
CPC ..... *A24F 40/40* (2020.01); *A24F 40/20* (2020.01); *A24F 40/51* (2020.01)

(58) Field of Classification Search
CPC ..... A24F 40/40; A24F 40/20; A24F 40/51
(Continued)

(56) References Cited

U.S. PATENT DOCUMENTS 8,910,783 B2 12/2014 Liu
10,111,470 B2 * 10/2018 Monsees ..... H05B 1/0244
(Continued)

FOREIGN PATENT DOCUMENTS

CA 3047236 A1 6/2018
CN 106455697 A 2/2017
(Continued)

OTHER PUBLICATIONS

International Search Report for PCT/EP2020/062065 dated Aug. 3, 2020, 3 pgs.
(Continued)

*Primary Examiner* — Alexander Gilman
(74) *Attorney, Agent, or Firm* — Lerner David LLP

(57) ABSTRACT

An aerosol generation device has a body, a closure, and a resilient element. The body has an aperture through which an aerosol substrate is receivable. The closure is moveable relative to the aperture between a closed position in which the closure covers the aperture and an open position in which the aperture is substantially unobstructed by the closure. The resilient element is arranged so as to bias the closure towards the closed position from a first range of positions between the closed position and the open position and to bias the closure towards the open position from a second range of positions between the closed position and the open position. The first range of positions of the closure is closer to the closed position than the second range of positions. The second range of positions of the closure is closer to the open position than the first range of positions.

20 Claims, 26 Drawing Sheets

(58) Field of Classification Search
USPC ..... 131/329
See application file for complete search history.

(56) References Cited

U.S. PATENT DOCUMENTS

| | | | | |
|---|---|---|---|---|
| 10,206,428 | B2 * | 2/2019 | Thorens | A24F 40/40 |
| 10,426,193 | B2 | 10/2019 | Schennum et al. | |
| 11,134,722 | B2 * | 10/2021 | Verleur | A61M 11/042 |
| 2010/0224627 | A1 | 9/2010 | Yang et al. | |
| 2014/0348495 | A1 | 11/2014 | Greim | |
| 2015/0020832 | A1 | 1/2015 | Greim et al. | |
| 2015/0257451 | A1 * | 9/2015 | Brannon | A24F 40/30 131/328 |
| 2015/0272211 | A1 * | 10/2015 | Chung | A24F 40/40 206/242 |
| 2016/0120218 | A1 | 5/2016 | Schennum et al. | |
| 2017/0079327 | A1 * | 3/2017 | Wu | H02J 7/007 |
| 2017/0117654 | A1 * | 4/2017 | Cruz | A24F 40/40 |
| 2017/0188633 | A1 | 7/2017 | Force | |
| 2017/0196264 | A1 * | 7/2017 | Liu | A24F 40/60 |
| 2017/0222468 | A1 | 8/2017 | Schennum et al. | |
| 2017/0304567 | A1 * | 10/2017 | Adelson | A61M 11/042 |
| 2018/0027880 | A1 * | 2/2018 | Dong | F16K 31/50 |
| 2018/0036754 | A1 * | 2/2018 | Scott | B65D 47/32 |
| 2018/0042305 | A1 * | 2/2018 | Hogwood | A61M 15/0003 |
| 2018/0140018 | A1 * | 5/2018 | Hu | H05B 3/44 |
| 2018/0277805 | A1 * | 9/2018 | Chen | A24F 15/01 |
| 2018/0310614 | A1 * | 11/2018 | Xu | A61M 15/06 |
| 2018/0310616 | A1 * | 11/2018 | Clemens | H05B 1/0244 |
| 2019/0098931 | A1 * | 4/2019 | Leadley | A61M 15/06 |
| 2019/0335807 | A1 | 11/2019 | Tang et al. | |
| 2020/0093185 | A1 | 3/2020 | Lim, II | |
| 2022/0142247 | A1 * | 5/2022 | Mason | A24F 40/20 |
| 2022/0142250 | A1 | 5/2022 | Bouchuiguir et al. | |
| 2022/0183357 | A1 | 6/2022 | Sayed et al. | |
| 2023/0112844 | A1 | 4/2023 | Force | |

FOREIGN PATENT DOCUMENTS

| | | | |
|---|---|---|---|
| CN | 106509991 | A | 3/2017 |
| CN | 106572700 | A | 4/2017 |
| CN | 106901404 | A | 6/2017 |
| CN | 206687163 | U | 12/2017 |
| CN | 207383538 | U | 5/2018 |
| CN | 207613193 | U | 7/2018 |
| CN | 108366625 | A | 8/2018 |
| CN | 108552611 | A | 9/2018 |
| CN | 108778006 | A | 11/2018 |
| CN | 208425528 | U | 1/2019 |
| CN | 208783785 | U | 4/2019 |
| EP | 3003073 | B1 | 3/2018 |
| JP | 2021023137 | A | 2/2021 |
| JP | 2022522781 | A | 4/2022 |
| WO | 2018122177 | A1 | 7/2018 |
| WO | 2018202732 | A1 | 11/2018 |
| WO | 2018216961 | A1 | 11/2018 |
| WO | 2019081906 | A1 | 5/2019 |

OTHER PUBLICATIONS

International Search Report for PCT/EP2020/062061 dated Aug. 3, 2020. 4 pgs.

Search Report dated Nov. 24, 5223 from the Office Action for Chinese Application No. 202080031097.6 dated Nov. 28, 2023, pp. 1-3.

Search Report dated Jan. 17, 2024 from the Office Action for Chinese Application No. 202080031095.7 issued Jan. 19, 2024, 3 pages.

* cited by examiner (a)

(b)

AEROSOL GENERATION DEVICE WITH CLOSURE

CROSS-REFERENCE TO RELATED APPLICATIONS

The present application is a national phase entry under 35 U.S.C. § 371 of International Application No. PCT/EP2020/062065, filed Apr. 30, 2020, published in English, which claims priority to European Application No. 19172662.9 filed May 3, 2019 and European Application No. 19192164.2 filed Aug. 16, 2019, the disclosures of which are incorporated herein by reference.

FIELD OF THE DISCLOSURE

The present disclosure relates to an aerosol generation device having a closure. The closure may be arranged so as to be moveable between a closed position and an open position. The disclosure is particularly, but not exclusively, applicable to a portable aerosol generation device, which may be self-contained and low temperature. Such devices may heat, rather than burn, tobacco or other suitable materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or agitate an aerosol substrate to produce an aerosol and/or vapour for inhalation, as opposed to burning tobacco as in conventional tobacco products.

One type of reduced-risk or modified-risk device is a heated substrate aerosol generation device, or heat-not-burn device. Devices of this type generate an aerosol and/or vapour by heating a solid aerosol substrate, typically moist leaf tobacco, to a temperature typically in the range 150° C. to 300° C. Heating an aerosol substrate, but not combusting or burning it, releases an aerosol and/or vapour that comprises the components sought by the user but not the toxic and carcinogenic by-products of combustion and burning. Furthermore, the aerosol and vapour produced by heating the aerosol substrate, e.g. tobacco, does not typically comprise the burnt or bitter taste resulting from combustion and burning that can be unpleasant for the user. This means that the aerosol substrate does not require sugars or other additives that are typically added to the tobacco of conventional tobacco products to make the smoke and/or vapour more palatable for the user.

Existing aerosol generation devices can be awkward to use and the required components can lack user-friendliness. For example, it is helpful to provide a cover that can protect the region of the device where the aerosol substrate is provided for use; this cover is moved frequently by the user of the device and so a cover that lacks user-friendliness is undesirable.

EP 3003073 B1 describes a container for an elongate electronic nicotine delivery system or other flavoured vapour delivery system. The container has a lid that is pivotally attached to a body so that it covers first and ancillary openings in the insert in a closed position.

CN 206687163 U describes a low-temperature smoking article, comprising a cover body that is movably mounted on a casing and configured to be movable between a first position and a second position. A trigger switch is provided for activating or conducting the power supply circuit.

In both of the prior art publications, the lid is simple and no mechanism for effectively controlling movement of the lid is disclosed.

SUMMARY OF THE DISCLOSURE

Aspects of the disclosure are set out in the accompanying claims.

According to a first aspect of the disclosure, there is provided an aerosol generation device comprising:

a body having an aperture through which an aerosol substrate is receivable into the aerosol generation device;

a closure moveable relative to the aperture between a closed position in which the closure covers the aperture and an open position in which the aperture is substantially unobstructed by the closure; and a resilient element arranged so as to bias the closure towards the closed position from a first range of positions between the closed position and the open position and to bias the closure towards the open position from a second range of positions between the closed position and the open position, the first range of positions of the closure being closer to the closed position than the second range of positions and the second range of positions of the closure being closer to the open position than the first range of positions, a first end of the resilient element being arranged to cooperate with the closure so as to move in a first direction between a first position when the closure is in the closed position and a second position when the closure is in the open position, the resilient element being oriented to deform in a second direction transverse to the first direction towards and/or away from the body relative to the closure to provide the biasing as the first end moves between the first position and the second position.

It will be appreciated that the described arrangement may allow the resilient element to bias the closure into both the open and closed position. Moreover, by arranging the resilient member to deform towards or away from the casing, the resilient member typically tends to force the closure towards or away from the hand of the user as the user interacts with the closure. This may significantly improve the feel of the closure and/or counteract undesired freedom of movement of the closure, e.g. resulting from poor manufacturing tolerances or the like.

Optionally, the first range of positions is adjacent or substantially adjacent to the second range of positions.

Optionally, the resilient element is arranged to resist movement away from the closed position; optionally the resilient element is arranged to resist movement away from the closed position when the closure is in the first range of positions.

Optionally, the resilient element is arranged to resist movement away from the open position; optionally the resilient element is arranged to resist movement away from the open position when the closure is in the second range of positions.

Optionally, the closure is stable in each of the closed position and the open position.

Optionally, the resilient element is arranged so as to provide a biasing force resisting movement away from the closed position when the first end is at the first position and/or the resilient element is arranged so as to provide a biasing force resisting movement away from the open position when the first end is at the second position.

Optionally, the resilient element is a spring, preferably a torsion spring, more preferably a helical torsion spring, e.g. it is at least one of a spring, a torsion spring or a helical torsion spring.

Optionally, the resilient element is arranged so as to deform in a direction out of a plane defined by the aperture.

Optionally, the resilient element is arranged so as to deform in a direction aligned with an axis of the aperture and/or a direction aligned with the direction in which the aerosol substrate is receivable.

Optionally, the first end of the resilient element is attached to the closure.

Optionally, a second end of the resilient element is attached to the body.

Optionally, the aerosol generation device comprises a guide, wherein the first end of the resilient element, and/or a component that interacts with the first end of the resilient element, is arranged to move along the guide so as to move the first end of the resilient element between the first position and the second position. Preferably, the guide has an arc-shaped guiding or linear path. Preferably, a direction of the movement of the first end of the resilient element along the guide is tangential to the body.

Optionally, a direction of the movement of the closure from the closed position to the open position is tangential to the body.

Optionally, a direction of the movement of the closure from the closed position to the open position is in the direction of, e.g. towards or away from, the body.

Optionally, the resilient element is arranged so as to bias the first end towards a side of the guide; preferably, the side is the side either furthest from or closest to the closure.

Optionally, the resilient element is arranged so as to force the first end of the resilient element directly away from the body towards the closure.

Optionally, the resilient element is arranged so as to bias the first end of the resilient element directly away from the closure towards the body.

Optionally, the resilient element is arranged so as to maximally deform when the first end of the resilient element is midway between the first position and the second position.

Optionally, the resilient element is arranged so as to maximally deform when the first end of the resilient element is at a position offset from midway between the first position and the second position.

Optionally, the closure is further moveable to an activation position at which the aerosol generation device is operable to initiate an activation signal.

Optionally, the closure is slideable to reach the activation position.

Optionally, the closure is further moveable from the open position to an activation position at which the aerosol generation device is operable to initiate an activation signal, wherein the resilient element is arranged so as to deform as the closure moves from the open position to the activation position.

Optionally, the first end of the resilient element is arranged so as to be moveable between the second position and a third position, wherein at the third position the closure is in the activation position.

Optionally, the first end of the resilient element is arranged so as to be moveable between the second position and the third position in a direction parallel to a direction of deformation.

Optionally, a direction of the further movement of the closure from the open position to the activation position is transverse to a direction of the movement of the closure between the closed position and the open position.

Optionally, a/the direction of the further movement of the closure from the open position to the activation position is towards the aerosol generation device.

Optionally, a/the direction of the further movement of the closure from the open position to the activation position is the same as a/the direction of the sliding of the closure from the closed position to the open position, with the activation position being beyond the open position relative to the closed position.

Optionally, the aerosol generation device comprises an activation guide along which the further movement of the first end from the second position to the third position is performed.

Optionally, the guide and the activation guide each extend from a junction at which they are contiguous with one another, the junction being associated with the open position.

Optionally, the aerosol generation device comprises an activation detector arranged so as to detect movement of the closure to a/the activation position in order to initiate a/the activation signal.

Optionally, the aerosol generation device comprises an opening detector arranged so as to detect movement of the closure to the open position from the closed position in order to initiate a status signal when the closure arrives at the open position from the closed position.

Optionally, at least one of a/the activation detector and a/the opening detector is a push-button, indexing cog, electrical contact, Hall effect sensor, optical sensor, switch, deflection sensor, strain gauge, induction sensor or ultrasound sensor.

Optionally, the resilient element being oriented to deform comprises the resilient element being arranged so as to compress.

Optionally, the resilient element being oriented to deform comprises the resilient element being arranged so as to extend.

Optionally, the closure is further moveable to a second activation position at which the device is operable to initiate a second activation signal. The closure may be moveable from the open position to the second activation position, from the closed position to the second activation position or from the activation position to the second activation position. Optionally, the second activation position is at a different location to the activation position.

Optionally, the closure is moveable to a plurality of different activation positions from the open position, the closed position, and/or the activation position. The closure may be moveable between the open position and a plurality of open activation positions, the closed position and a plurality of closed activation positions and/or the activation positions and a plurality of further activation positions.

Optionally, the closure is slidable to reach the second activation position and/or each one of the plurality of the activation positions.

Optionally, the a/the direction of the further movement of the closure from the open position to the second activation position is towards the body of the aerosol generation device.

Optionally, the a/the direction of the further movement of the closure from the open position to the second activation position is the same as a direction of the movement of the closure from the closed position to the open position.

Optionally, a/the direction of the further movement of the closure from the open position to the second activation position is transverse to a direction of the movement of the closure between the closed position and the open position Optionally, the device is arranged to initiate a different activation signal for each of the plurality of activation positions.

Optionally, the closure is biased away from the second activation position and/or one or more of the plurality of activation positions. Optionally, the resilient element is arranged so as to bias the closure away from the second activation position and/or one or more of the plurality of activation positions. Optionally, the aerosol generation device comprises a second resilient element arranged to bias the closure away from the second activation position.

Optionally, the resilient element is arranged so that there is a different biasing force for two or more of the activation position, the second activation position, and/or the plurality of activation positions.

Optionally, the first end of the resilient element is mounted on a first component and a second end of the resilient element is mounted on a second component, wherein at least a part of the first component is located within a volume defined by the second component.

Optionally, the second component comprises a first part and second part, the first part and the second part being arranged to fit together. Preferably, the first part and the second part are arranged to fit together around the first component.

Optionally, the first end of the resilient element is arranged to fit within a cavity defined by the first component. Optionally, the second end of the resilient element is arranged to fit within a cavity defined by the second component.

Optionally, the second component comprises a guide, wherein a protrusion of the first component is arranged to move along the guide as the closure is moved between the closed position and the open position. Preferably, the guide has an arc-shaped guiding or linear path.

Optionally, the resilient element is arranged so as to bias the first end of the resilient element towards a side of the guide, wherein the side is the side either furthest from or closest to the closure. Preferably, the resilient element is arranged so as to force the first end of the resilient element directly towards the closure away from the body.

Optionally, the closure is further moveable from the open position to an activation position at which the aerosol generation device is operable to initiate an activation signal. Preferably, the resilient element is arranged so as to deform as the closure moves from the open position to the activation position.

Optionally, a/the protrusion of the first component is arranged to move along a sensor guide as the closure moves between the open position and an activation position.

Optionally, a component of the first part is arranged to interact with an activation detector as the closure moves between the open position and the activation position.

According to a second aspect of the disclosure, there is provided a method of operating an aerosol generation device having:

a body, the body having an aperture through which an aerosol substrate is receivable into the aerosol generation device;

a closure, the closure being moveable relative to the aperture between a closed position in which the closure covers the aperture and an open position in which the aperture is substantially unobstructed by the closure; and a resilient element, the resilient element being arranged so as to bias the closure towards the closed position from a first range of positions between the closed position and the open position and to bias the closure towards the open position from a second range of positions between the closed position and the open position, the first range of positions of the closure being closer to the closed position than the second range of positions and the second range of positions of the closure being closer to the open position than the first range of positions, the method comprising:

moving a first end of the resilient element in a first direction between a first position and a second position, wherein the closure is arranged so as to move between the closed position when the first end is at the first position and the open position when the first end is in the second position, wherein the resilient element is oriented to deform in a second direction transverse to the first direction towards and/or away from the body relative to the closure to provide the biasing as the first end moves between the first position and the second position.

Each of the aspects above may comprise any one or more features mentioned in respect of the other aspects above.

The disclosure extends to any novel aspects or features described and/or illustrated herein. Further features of the disclosure are characterised by the other independent and dependent claims.

Use of the words "apparatus", "device", "processor", "module" and so on are intended to be general rather than specific. Whilst these features of the disclosure may be implemented using an individual component, such as a computer or a central processing unit (CPU), they can equally well be implemented using other suitable components or a combination of components. For example, they could be implemented using a hard-wired circuit or circuits, e.g. an integrated circuit, and using embedded software.

It should be noted that the term "comprising" as used in this document means "consisting at least in part of". So, when interpreting statements in this document that include the term "comprising", features other than that or those prefaced by the term may also be present. Related terms such as "comprise" and "comprises" are to be interpreted in the same manner. As used herein, "(s)" following a noun means the plural and/or singular forms of the noun.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

Preferred embodiments are now described, by way of example only, with reference to the accompanying drawings.

BRIEF DESCRIPTION OF THE DRAWINGS

FIG. 3(*b*) is a schematic cross-sectional view from the side of the first embodiment of the closure, where the closure is in an open position.

FIG. 3(*c*) is a schematic cross-sectional view from the side of the first embodiment of the closure, where the closure is in an, optionally provided, activation position.

FIG. 3(*d*) is another schematic cross-sectional view from the side of the first embodiment of the closure, where the closure is in the activation position.

FIG. 7(*b*) is a schematic cross-sectional view from the side of the second embodiment of the closure, where the closure is in an open position.

FIG. 7(*c*) is a schematic cross-sectional view from the side of the second embodiment of the closure, where the closure is in an activation position.

FIG. 7(*d*) is another schematic cross-sectional view from the side of the second embodiment of the closure, where the closure is in the activation position.

FIG. 10(*b*) is a schematic cross-sectional view from the side of the fourth embodiment of the closure, where the closure is in an open position.

FIG. 10(*c*) is a schematic cross-sectional view from the side of the fourth embodiment of the closure, where the closure is in an activation position.

FIG. 10(*d*) is another schematic cross-sectional view from the side of the fourth embodiment of the closure, where the closure is in the activation position.

FIG. 12(*b*) is a schematic cross-sectional view from the side of the fifth embodiment of the closure, where the closure is in an open position.

FIG. 12(*c*) is a schematic cross-sectional view from the side of the fifth embodiment of the closure, where the closure is in an activation position.

FIG. 12(*d*) is another schematic cross-sectional view from the side of the fifth embodiment of the closure, where the closure is in the activation position.

FIG. 14(*b*) is a schematic cross-sectional view from the side of the sixth embodiment of the closure, where the closure is in an open position.

FIG. 14(*c*) is a schematic cross-sectional view from the side of the sixth embodiment of the closure, where the closure is in an activation position.

FIG. 14(*d*) is another schematic cross-sectional view from the side of the sixth embodiment of the closure, where the closure is in the activation position.

FIG. 15(*b*) is a view of another closure attachment mechanism for the closure.

DETAILED DESCRIPTION OF THE EMBODIMENTS

First Embodiment

Figure 1:
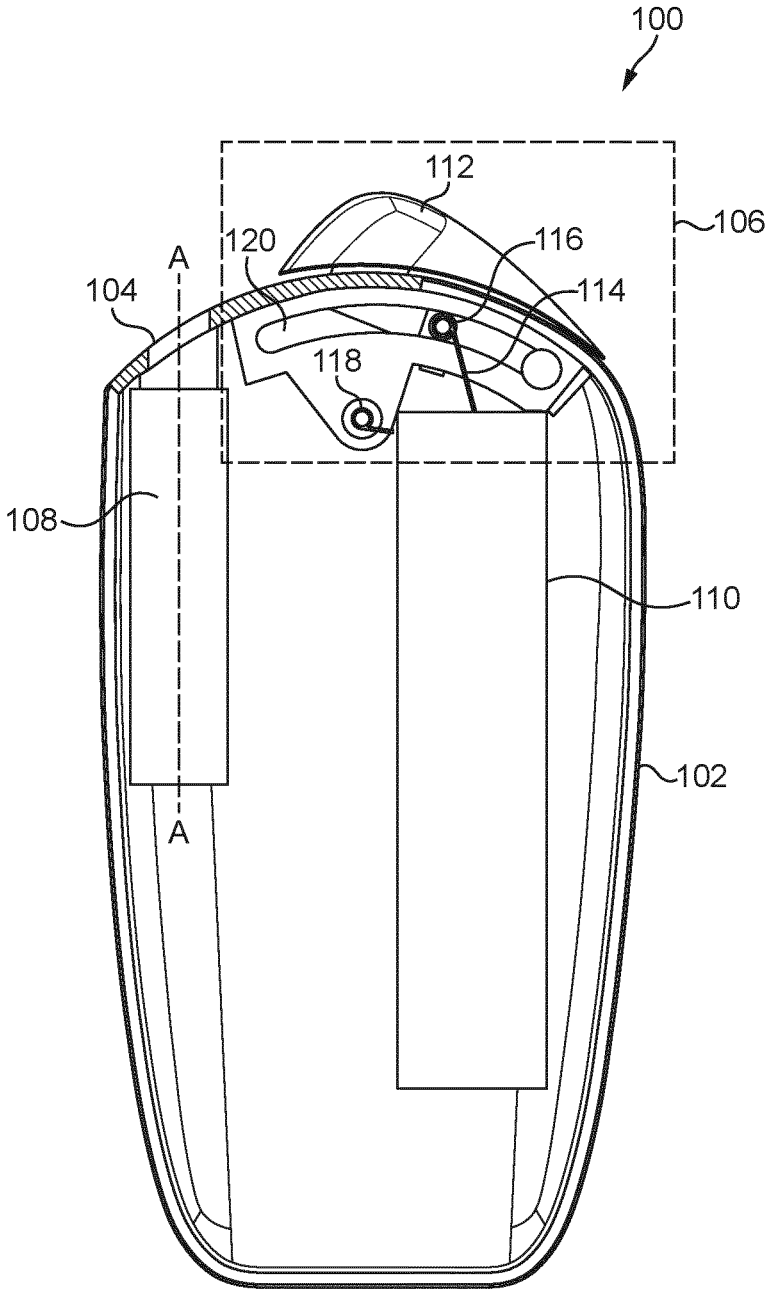
FIG. 1 is a schematic perspective view of a first embodiment of an aerosol generation device.

Referring to FIG. 1, according to a first embodiment of the disclosure, an aerosol generation device 100 comprises a body 102 housing various components of the aerosol generation device 100. The body 102 can be any shape so long as it is sized to fit the components described in the aerosol generation device 100. The body 102 can be formed of any suitable material, or indeed layers of material.

A first end of the aerosol generation device 100 that is an end near to the closure 106, shown towards the top of FIG. 1, is described for convenience as the top or upper end of the aerosol generation device 100. A second end of the aerosol generation device 100 that is an end further from the closure 106, shown towards the bottom of FIG. 1, is described for convenience as a bottom, base or lower end of the aerosol generation device 100. Movement from the top of the aerosol generation device 100 to the bottom of the aerosol generation device 100 is described for convenience as down, while movement from the bottom of the aerosol generation device 100 to the top of the aerosol generation device 100 is described for convenience as up. During use, the user typically orients the aerosol generation device 100 with the first end downward and/or in a distal position with respect to the user's mouth and the second end upward and/or in a proximate position with respect to the user's mouth.

The aerosol generation device 100 comprises a heating chamber 108 located towards a first end of the aerosol generation device 100. At one end of the heating chamber 108, there is provided an aperture 104 through the body 102; the aperture 104 provides access to the heating chamber 108 from outside the body 102, so that an aerosol substrate be placed into the heating chamber 108 via the aperture 104.

At the aperture 104, where the heating chamber 108 is proximate to the body 102, one or more spacing elements, such as washers are provided to mount the heating chamber 108 in position. The spacing elements reduce the conduction of heat from the heating chamber 108 to the body. There is typically an air gap otherwise surrounding the heating chamber 108, so that transfer of heat from the heating chamber 108 to the body 102 other than via the spacing elements is also reduced.

In order to increase the thermal isolation of the heating chamber 108 further, the heating chamber 108 is also surrounded by insulation (not shown). In some embodiments, the insulation is fibrous or foam material, such as wool. In some embodiments, the insulation comprises a pair of nested tubes or cups enclosing a cavity therebetween. The cavity can be filled with a thermally insulating material, for example fibres, foams, gels or gases (e.g. at low pressure) and/or the cavity may comprise a vacuum. Advantageously, a vacuum requires very little thickness to achieve high thermal insulation.

The aperture 104 is typically a circular aperture that is centred on an axis A-A. It will be appreciated that any shape of aperture may be used, e.g. a square or triangular aperture may be used, where the axis A-A passes through the centre of the aperture 104. The axis A-A can be considered as an axis perpendicular to a plane formed by the aperture 104—e.g. that plane on which the aperture 104 lies. More specifically, a 2D shape, typically a circle, can be formed from the perimeter of the aperture 104 as seen when looking towards the aperture 104. This 2D shape lies on a plane, which is a plane defined by the aperture 104.

The heating chamber 108 is typically formed by deep drawing. This is an effective method for forming the heating chamber 108 and can be used to provide a thin side wall. The deep drawing process involves pressing a sheet metal blank with a punch tool to force it into a shaped die. By using a series of progressively smaller punch tools and dies, a tubular structure is formed which has a base at one end and which has a tube that is deeper than the distance across the tube (it is the tube being relatively longer than it is wide which leads to the term "deep drawing"). Similarly, the base formed in this way is the same thickness as the initial sheet metal blank. A flange can be formed at the end of the tube by leaving a rim of the original sheet metal blank extending outwardly at the opposite end of the tubular wall to the base (i.e. starting with more material in the blank than is needed to form the tube and base). Alternatively, a flange can be formed afterwards in a separate step involving one or more of cutting, bending, rolling, swaging, etc. The heating chamber 108 being formed by deep drawing results in an aperture 104 that is formed during the deep drawing process.

The aerosol generation device 100 comprises a closure 106 arranged so as to be moveable between at least a closed position, in which the closure obstructs the aperture 104 so that materials cannot enter the heating chamber 108, and an open position, in which the aperture 104 is uncovered to allow access to the heating chamber 108. The closure 106 may comprise an external cover 112, the external cover 112 being provided external to the body 102 of the aerosol generation device 100 and thereby being available for interaction with a user. The aerosol generation device 100 comprises a resilient element 114 arranged to deform as the closure 106 moves; and comprises a guide 120 along which a first end 116 of the resilient element 114 is arranged to move.

The closure 106 is typically arranged to be moveable between the closed position and the open position by sliding relative to the body 102; typically, the first end 116 of the resilient element 114 moves along the guide 120 as the closure 106 slides between the closed position and the open position. In some embodiments, the closure 106 is arranged to rotate between the closed position and the open position; in these embodiments, the rotation may be in any plane, e.g. the rotation may be in the plane formed by the aperture 104 or may be perpendicular or transverse to the plane formed by the aperture 104.

Typically, the resilient element 114 is a spring, such as a helical spring or a torsion spring. When the spring is deformed away from a relaxed position, the spring exerts a compressive force or an extensive force along an axis defined by the first end 116 of the resilient element 114 and a second end 118 of the resilient element 114. The force exerted by the spring is dependent on the deformation, where the magnitude of the force exerted increases as the magnitude of the deformation from the relaxed position increases.

The first end 116 of the resilient element 114 is arranged to interact with the closure 106 so as to move between a first position and a second position as the closure 106 is moved between the open position and the closed position. Typically, the resilient element is arranged so as to move along the guide 120 between the first position and the second position. The second end 118 of the resilient element 114 is attached to the body 102 so that as the closure 106 moves from the closed position to the open position, the first end 116 of the resilient element 114 moves, e.g. rotates, relative to the second end 118. The guide 120 is typically arranged so that as the first end 116 moves along the guide 120, the distance between the first end 116 and the second end 118 of the resilient element 114 changes and so the resilient element 114 is deformed leading to the resilient element 114 exerting a force on the first end 116. Typically, this comprises the resilient element 114 being compressed as the closure 106 moves away from the closed position so that the resilient element 114 resists displacement of the closure 106 away from the closed position.

The second end 118 is typically attached to a component of the closure 106 that is mounted to the body 102. The mounting of the second end 118 exerts a force that balances the force exerted by the resilient element 114 so that as the closure 106 moves from the closed position to the open position, the second end 118 is fixed in place relative to the body 102 while the first end 116 moves relative to the body 102.

The resilient element 114 is arranged so that the open position and the closed position are both "stable" positions; e.g. there is zero net force acting on the closure 106 when the closure 106 is at the open position or the closed position. In some embodiments, at each of the closed position and the open position the resilient element 114 is in a substantially relaxed position so that the resilient element 114 exerts no, or only a negligible, force on the first end 116 or the second end 118 of the resilient element 114. Typically, the resilient element 114 is arranged so as to be in a deformed position when the closure is in either of the closed position or the open position; here the resilient element 114 exerts a force when the closure is in either of the closed position or the open position; the force exerted by the resilient element 114 is balanced by a force exerted by a wall of the guide 120. In other words, the open and closed positions are positions of stable equilibrium. In these embodiments, a threshold force is required to displace the closure 106 from either of the closed position and the open position. The resilient element 114 is typically arranged so that the threshold force is sufficient to prevent the closure 106 from moving away from either position due to incidental contact (e.g. shifting in the pocket of a user), but not so high as to be difficult to move between positions. Typical values of the threshold force required to move the closure away from either of the stable positions are in the range of 0.1N to 10N, e.g. 3N.

Where the first end 116 of the resilient element 114 is at a position on the guide 120 that is neither the first position nor the second position, there is a net force placed on the first end 116, so that the first end 116 is biased towards one of the first position and the second position and the closure 106 is correspondingly biased towards one of the closed position and the open position. The direction in which the first end 116 is biased depends on the relative position of the first end 116 and the second end 118 so that when the first end 116 is to the "left" of the second end 118, the resilient element 114 exerts a force that acts to move the first end to the left; when the first end 116 is to the "right" of the second end 118, the resilient element 114 exerts a force that acts to move the first end 116 to the right. The resilient element 114 is arranged so that as the closure 106 is moved from the closed position to the open position the first end 116 moves relative to the second end 118 and the direction of the force exerted by the resilient element 114 changes. More specifically, the resilient element is arranged so that the force exerted by the resilient element 114 acts to bias the closure 106 towards the closed position from a first range of positions between the closed position and the open position and to bias the closure 106 towards the open position from a second range of positions between the closed position and the open position. The first range of positions is closer to the closed position than the second range of positions is to the closed position. Similarly, the second range of positions is closer to the open position than the first range of positions is to the open position.

Typically, the resilient element 114 is arranged so that the first range of positions is substantially adjacent to the second range of positions. Therefore, at every position (or substantially every position) of the closure between the closed position and the open position, the closure 106 is biased towards either the closed position or the open position. More specifically, there may be a position (or region) of unstable equilibrium located part between the first and second ranges of positions (for example part way between the open and closed positions) in the sense that the resilient element 114 exerts no net force on the closure 106. This usually occurs at the portion of the travel where the resilient element 114 changes between biasing the closure 106 towards the open position and biasing the closure 106 towards the closed position. Regions of unstable equilibrium are those where small displacements in any direction drive the closure away from the unstable equilibrium region. Typically, the resilient element 114 is arranged so that such regions of unstable equilibrium are as small as possible.

The resilient element 114 is arranged so that at substantially each position of the closure 106 between the closed position and the open position, a component of the deformation of the resilient element 114, and a component of the force exerted by the resilient element 114 is in the direction of the movement of the closure 106. The resilient element 114 is arranged so that when the closure 106 is in either of the closed position or the open position, this component of the force resists movement away from the closed position or the open position respectively. The resilient element 114 is further arranged so that a component of the deformation of the resilient element 114, and a component of the force exerted by the resilient element 114, is transverse to the direction of the movement of the closure 106; this component of the force acts to force the first end 116 of the resilient element 114 against a side of the guide 120. Typically, a component of the deformation of the resilient element 114, and a component of the force exerted by the resilient element 114 is in the direction towards and/or away from the body 102 relative to the closure 106, e.g. towards the top or bottom of the aerosol generation device 100. This force acts to keep the first end 116 of the resilient element 114 pressed against a side, typically the top side, of the guide 120 as the closure 106 is moved from the closed position to the open position. This results in a smooth sliding movement of the closure 106 that is pleasant for the user.

It will be appreciated that the aerosol generation device 100 may be held at any orientation. In general, a component of the deformation and/or force being described as "up" or "down" with reference to FIG. 1 may be considered to be a component of the deformation and/or the force being: in the direction of reception of material through the aperture 104, along an axis of the aperture 104, perpendicular or transverse to the plane defined by the aperture 104, perpendicular or transverse to a direction of movement of the closure 106, towards/away from the body 102 relative to the closure 106, and/or along the major axis of the aerosol generation device 100.

The first range of positions and the second range of positions are typically of comparable size, for example in some embodiments, the first range of positions is that where the first end 116 of the resilient element 114 is between the first position and the centre point of the guide 120 and the second range of positions is that where the first end 116 of the resilient element 114 is between the centre point of the guide 120 and the second position. In some embodiments, the first range of positions and the second range of positions are differently sized, for example the resilient element 114 may be arranged so that the second end 118 of the resilient element 114 is nearer to one end of the guide 120, e.g. nearer the first position than the second position (e.g. almost "below" and slightly to the "right" of the first end of the guide 120), in this case the second range of positions is larger than the first range of positions and only a small movement away from the closed position is required before the resilient element 114 acts to bias the closure 106 towards the open position.

In some embodiments, the resilient element 114 is arranged so that the biasing force differs when the first end 116 is in the first position as compared to when the first end 116 is in the second position. Thus, the force required to move the closure 106 away from the closed position towards the open position differs from the force required to move the closure 106 away from the open position towards the closed position. This may be achieved by, for example, locating the second end 118 of the resilient element closer to one end of the guide 120 than to the other end of the guide 120.

In some embodiments, the guide 120 is linear. Typically, the resilient element 114 is arranged so as to be compressed increasingly as the first end 116 moves through the first range of positions and so, with a linear guide, the magnitude of the force exerted by the resilient element increases as the first end 116 moves through the first range of positions. In the first embodiment, the guide 120 is arc-shaped so that as the first end 116 of the resilient element 114 moves along the guide 120 through the first range of positions the rate of increase in the deformation of the resistant element 114 decreases (and hence the rate of increase of the magnitude of the exerted force decreases). This arc-shaped guide of the first embodiment thus results in an exerted force that increases slightly (but less than with a linear guide) during movement of the closure 106 away from the closed position through the first range of positions.

In some embodiments, the guide 120 is an arc arranged so that a force of constant magnitude is placed on the first end 116 of the resilient element 114 as it moves through the first range of positions and/or the second range of positions. More specifically, in some embodiments, the guide 120 is arranged so that the distance between the first end 116 and the second end 118 of the resilient element 114 remains constant throughout the movement of the first end 116 along the guide; in these embodiments, the deformation of the resilient element 114 still changes as the first end 116 of the resilient element 114 moves since the direction of the deformation of the resilient element 114 changes. Thus, the direction of the force exerted on the first end 116 of the resilient element changes 114 (and the biasing direction changes).

In some embodiments, the guide 120 is arranged so that a decreasing force is placed on the first end 116 of the resilient element as it moves through the first range of positions and/or the second range of positions. This can be achieved, for example, by arranging the resilient element 114 and the guide 120 so that the resilient element 114 is compressed when the closure 106 is in the closed position and the magnitude of the compression of the resilient element 114 is reduced as the first end 116 is moved through the first range of positions.

As the first end 116 of the resilient element 114 moves along the guide 120, the direction of the force exerted by the resilient element 114 changes; at an equilibrium point there is no component of the force in either the direction of the closed position or in the direction of the open position, e.g. the force is in the "upwards" direction with no component to the "left" or "right". Before (to the closed side of) the equilibrium point, the biasing force exerted by the resilient element 114 acts to move the closure 106 towards the closed position. After (to the open side of) the equilibrium point, the biasing force exerted by the resilient element 114 acts to move the closure to the open position. It will be appreciated that the equilibrium point is a single point on the guide 120; in practice, it would be difficult to place the first end at the equilibrium point and so the first range of positions and the second range of positions are substantially adjacent. Further, in practice the inertia of the closure 106 as it is being moved between the open position and the closed position carries the first end 116 of the resilient element beyond the equilibrium position, so that it is typically unlikely that the closure 106 will come to rest stably between the closed position and the open position.

In some embodiments, the closure 106 is arranged to be further moveable from the open position to an activation position. In various embodiments, movement to the activation position from the open position includes movement: in the direction of the movement from the closed position to the open position, movement transverse to the direction of the movement from the closed position to the open position, and/or towards the body 102 relative to the closure 106.

In some embodiments, the aerosol generation device 100 does not have an activation position; typically, the closure 106 is then arranged to be moveable only between the open position and the closed position.

Typically, the resilient element 114 is arranged so as to be deformed when the closure 106 is moved from the open position to the activation position. Typically, the resilient element 114 is arranged so that the closure 106 is biased away from the activation position towards the open position.

The resilient element 114 may be arranged so as to deform when the closure 106 is moved between the closed position and the open position and/or when the closure 106 is moved between the open position and the activation position.

Typically, the resilient element 114 is arranged so that movement from the open position to the activation position occurs at least partially in a different direction to movement from the closed position to the open position. In this way, the force required to move the first end 116 from the first position to the second position may differ from the force required to move the first end from the second position to a third position, the third position being the position of the first end 116 when the closure 106 is in the activation position. This typically comprises the movement from the first position to the second position being primarily transverse to the direction of deformation of the spring, e.g. from "left" to "right" and the movement from the second position to the third position having a substantial component in the direction of the deformation of the spring, e.g. from "top" to "bottom". Thus, the movement from the first position to the second position requires a force, e.g. a force provided by a user of the aerosol generation device 100, acting against a relatively small component of the force exerted by the resilient element 114, the majority of the force being resisted by a side of the guide 120 while the movement from the second position to the third position typically requires a force acting against a proportionally greater component of the force exerted by the resilient element 114. In some embodiments, as the first end 116 of the resilient element 114 moves from the first position to the second position, the resilient element 114 primarily rotates, as the first end 116 moves from the second position to the third position, the resilient element 114 primarily compresses.

In some embodiments, a second resilient element (not shown) is arranged so as to bias the closure towards the open position from the activation position. The second resilient element may have a different stiffness, or require a different deformation force, than the resilient element 114.

Typically, the activation position is a transitory position, where a continuous force, e.g. a force provided by a user of the aerosol generation device 100, is required to keep the closure 106 in the activation position. The biasing force of the resilient element 114, or the second resilient element, acts to return the closure 106 to the open position if the force is removed.

In some embodiments, the activation position is also a stable position, e.g. the closure 106 is not biased away from the activation position. In these embodiments, the resilient element 114 acts so as to bias the closure 106 towards the open position from a third range of positions between the open position and the activation position and to bias the closure 106 towards the activation position from a fourth range of positions between the open position and the activation position. The third range of positions is closer to the open position than the fourth range of positions and the fourth range of positions is closer to the activation position than the third range of positions. Typically, the fourth range of positions is substantially smaller than the third range of positions, for example the first end 116 of the resilient element 114 may be arranged to fit into a recess at the activation position and to be biased towards the open position from any location where it is not in the recess, e.g. the first end 116 may "click into" and "click out of" the activation position.

The aerosol generation device 100 further comprises a battery 110, which powers a heater that heats the heating chamber 108.

Figure 2:
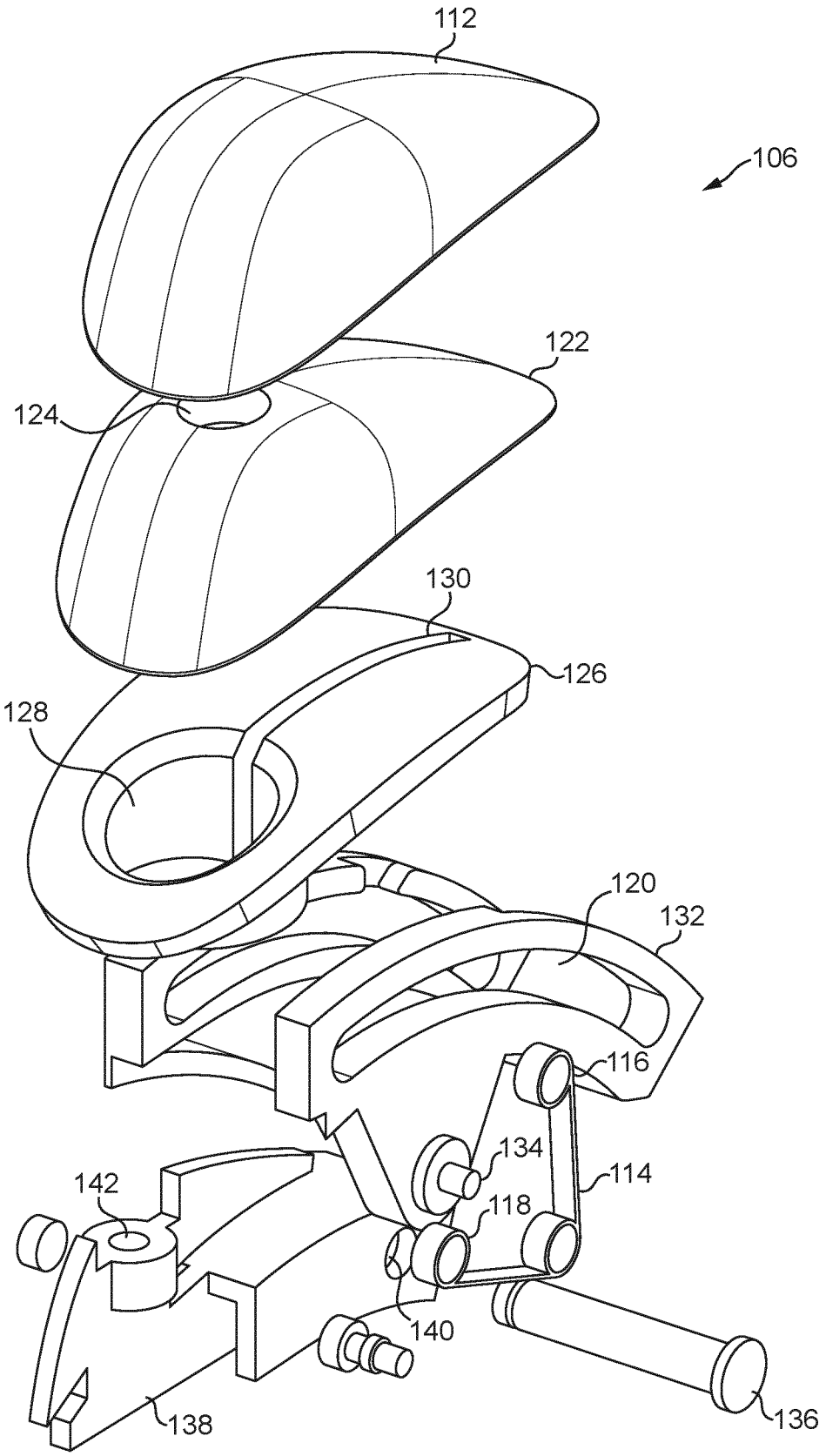
FIG. 2 is a component view of a closure of the aerosol generation device according to the first embodiment of the disclosure.

Referring to FIG. 2, there is shown a component view of the first embodiment of the closure 106.

The external cover 112 of the closure 106 is arranged on top of a guard 122, the guard 122, as well as the external cover 112, is arranged to cover the aperture 104 when the closure 106 is in the closed position. The external cover 112 may comprise tactile elements, such as buttons or a pliable material to improve the user experience of interacting with the closure 106.

Both the external cover 112 and the guard 122 are arranged so as to be located external to the body 102 when the aerosol generation device 100 is assembled; the guard 122 contains means to be connected to one or more of the internally located components of the closure 106, so that the user can, by interacting with the external cover 112, interact with the internal components of the closure 106. In this embodiment, the guard 122 comprises a guard aperture 124 located on the guard 122 so as to enable the guard 122 to be connected to internal components of the closure 106.

An aperture cover 126 is arranged to fit within the aperture 104, with an axis of a cover aperture 128 coincident with the axis A-A of the aperture 104. The aperture cover 126 is arranged to situate the closure on the body 102 so that in the closed position, the closure 106 covers the cover aperture 128 and the aperture 104.

The aperture cover 126 comprises a channel 130, through which components of the closure 106 internal to the body 102 are connectable to components of the closure 106 external to the body 102.

The guide 120 is located in a guide component 132 that is secured to the body 102. The securing means may comprise a snap fit, an adhesive, screws, pins, or other securing means. The guide element 132 further comprises a mounting point 134 to which the second end 118 of the resilient element 114 can be attached, thereby securing the second end 118 in place relative to the body 102. The mounting point 134 is arranged to hold the second end 118 in place relative to the body 102. Typically, the mounting point 134 is a protrusion around which the second end 118 is placed. The axis of the protrusion is perpendicular to the direction of deformation of the resilient element 114, so that the second end 118 does not move away from the protrusion during use, yet the second end 118 is easily removed from the protrusion for disassembly or cleaning.

The guide 120 typically comprises two guide sections, enclosed by material to the top and bottom of the guide sections, which extend along either side of the guide component 132. Between the two guide sections there is typically a cut-out. Therefore, a movement pin 136 can be placed through each of the guide sections; the movement pin 136 may also extend to one or more sides of the guide component 132.

The first end 116 of the resilient element 114 is arranged to interact with the movement pin 136. Typically, the first end 116 of the resilient element 114 is attached to the movement pin 136 or is attached to a component that moves with the movement pin 136; in some embodiments, the first end 116 is arranged to be pushed or pulled by the movement pin 136. Since the movement pin 136 is arranged to interact with the first end 116 of the resilient element 116, following references to the movement of the first end 116 of the resilient element 114 along the guide 120 also indicate movement of the movement pin 136 along the guide 120 and vice versa.

The movement pin 136 is arranged to be moveable between the first end of the guide 120 and the second end of the guide 120. The movement pin 136 is further arranged to abut the guide element 132 at the "top" and "bottom" side of the guide 120 such that movement of the movement pin 136 through the channel 130 is resisted—thereby ensuring that the movement pin 136 remains in the guide 120.

The closure further comprises a linkage 138, which is arranged so as to connect the external elements of the closure 106, e.g. the guard 22 and the external cover 112, to the internal elements of the closure 106, e.g. the movement pin 136 and the guide section 132. The linkage 138 comprises a guard attachment 142 that is arranged so as to connect the linkage 138 to the guard 122. In this embodiment, the guard attachment 142 comprises an aperture and a pin, where the pin can be inserted through the aperture of the guard attachment 142 and through the guard aperture 124 to connect the guard 122 to the linkage 138. In some embodiments, the guard attachment 142 comprises screws, adhesives, or other attachment means.

The linkage 138 also comprises a guide attachment 140 arranged so as to interact with the first end 116 of the resilient element 114. The guide attachment 140 of the first embodiment comprises a hole arranged to fit the movement pin 136. The movement pin 136 can be inserted through the guide 120 and through the guide attachment 140, so that movement of the guard 122 leads to movement of the linkage 138 and thereby to movement of the movement pin 136 along the guide 120.

More generally, force being placed on the external cover 112 by the user results in a force being placed on the guard 122 and therefore results in a force being placed on the movement pin 136, and a force being placed on the first end 116 of the resilient element 114.

The linkage 138 is sized so that at least a part of the body of the linkage 138 is able to pass through the channel 130 of the aperture cover 126.

To assemble the closure 106, the linkage 138 is connected to the guard 122 using the guard attachment 142. The linkage 138 is then passed through the channel 130 of the aperture cover element 126 so that the location of the guide attachment 140 coincides with the location of the guide 120 of the guide component 132. The movement pin 136 is then inserted through the first guide section, through the guide attachment 140 and through the second guide section. The movement pin 136 abuts a side of the guide 120 so as to prevent removal of the linkage 138 through the channel 130 of the aperture cover 126. The first end 116 of the resilient element 114 is attached, directly or indirectly, to the movement pin 136 and the second end 118 of the resilient element 114 is attached to the mounting point 134. The guard 122 is connected to the movement pin 136, and hence the first end 116 of the resilient element, via the linkage 138. The user is thus able to move the first end 116 of the resilient element by moving the external cover of the closure 106. The closure 106 is then placed into the body 102 of the aperture, and secured in place, e.g. by a snap fit.

Figure 3:
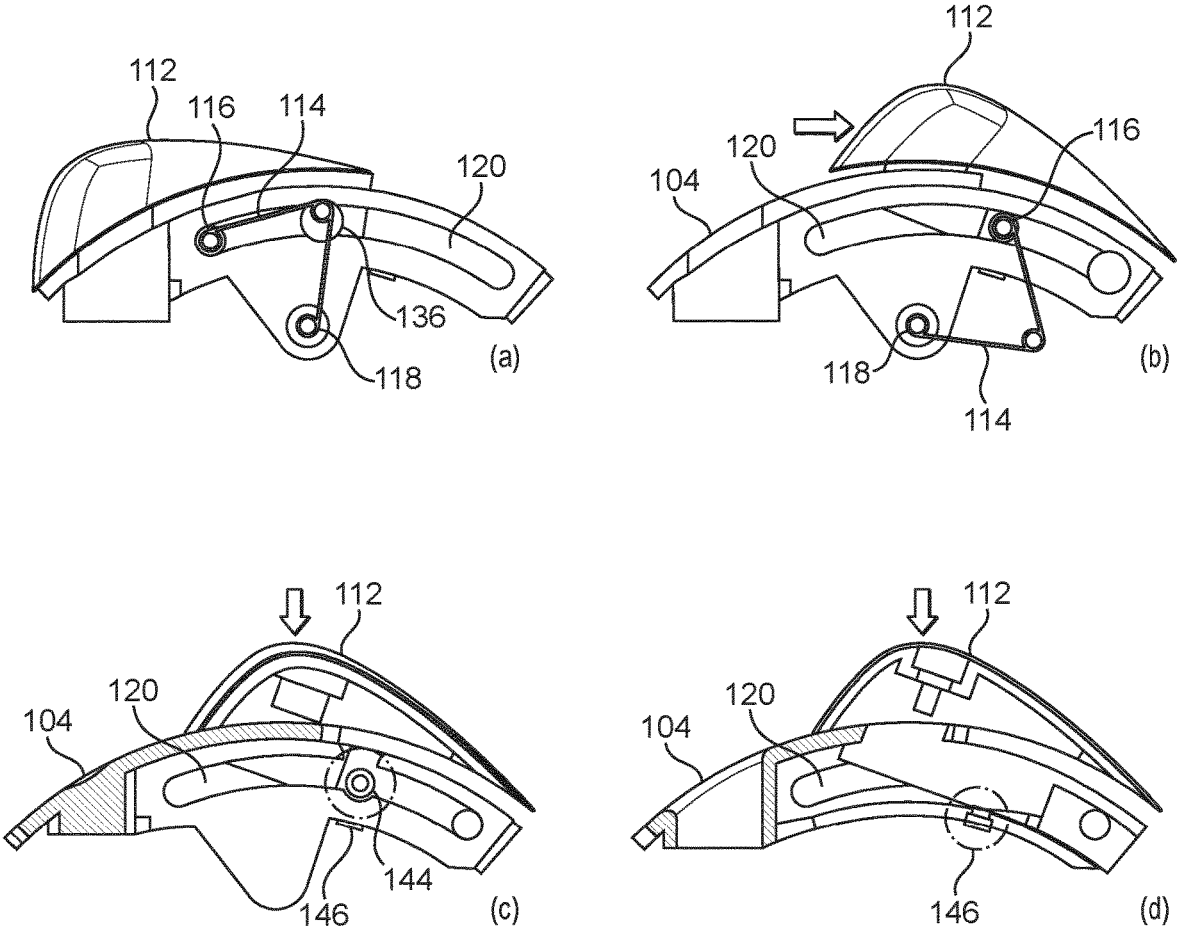
FIG. 3(*a*) is a schematic cross-sectional view from the side of the first embodiment of the closure, where the closure is in a closed position.

Referring to FIG. 3, the components of the closure 106 are shown when the closure 106 is in each position.

Referring to FIG. 3*a*, there is shown the closure 106 in the closed position. In this position, the closure 106 covers the aperture 104 of the aerosol generation device 100. The resilient element 114 is arranged so that when the closure 106 is in the closed position, the resilient element 114 resists movement of the closure 106 away from the closed position. In the first embodiment, the resilient element 114 comprises a torsion spring; as the first end 116 of the resilient element is moved away from the first position along the guide 120 the resilient element 114 exerts a compressive force that acts in line with an axis that joins the first end 116 and the second end 118 of the resilient element. A component of the compressive force acts to move the closure 106 to the closed position.

Referring to FIG. 3*b*, when the closure 106 is in the open position, the resilient element 114 is arranged so as to resist movement of the closure 106 away from the open position in a way equivalent to that described with reference to the resistance of movement away from the closed position.

When the closure 106 is in between the closed position and the open position, the direction of the force placed on the first end 116 of the resilient element 114 depends on the location of the first end 116. Initially, as the closure 106 is moved away from the closed position the resilient element 114 acts to bias the closure 106 towards the closed position. As the closure 106 is moved further away from the closed position towards the open position, the first end 116 of the resilient element 114 moves away from the first position towards the second position; once the first end 116 of the resilient element 114 moves past the equilibrium point, the direction of the force placed on the first end 116 changes and the resilient element 114 acts to bias the closure 106 towards the open position.

Referring to FIG. 3*c*, the closure 106 is shown in the activation position. In some, but not all, embodiments, from the open position, the closure 106 is further moveable to reach an activation position; typically, the closure 106 is arranged so as to be moveable towards the body 102 of the aerosol generation device 100 to reach the activation position, preferably by the first end 114 of the resilient element 114 moving along a dedicated activation guide positioned transversally to the guide. As the closure 106 is moved towards the body 102, the movement pin 136 is arranged to move towards an activation detector 146 located on the closure 106 or the body. More specifically, the movement pin 136 is arranged to move along a sensor guide 144 defined by the activation detector 146, which in this embodiment is a push button. As the movement pin 136 moves along the sensor guide 144, the push button is depressed. The depression of the push button initiates an activation signal, which, for example, is useable to initiate operation of the heater.

Referring to FIG. 3*d*, there is shown a further view of the closure 106 in the activation position, where the depression of the activation detector 146 is shown more clearly.

Figure 4:
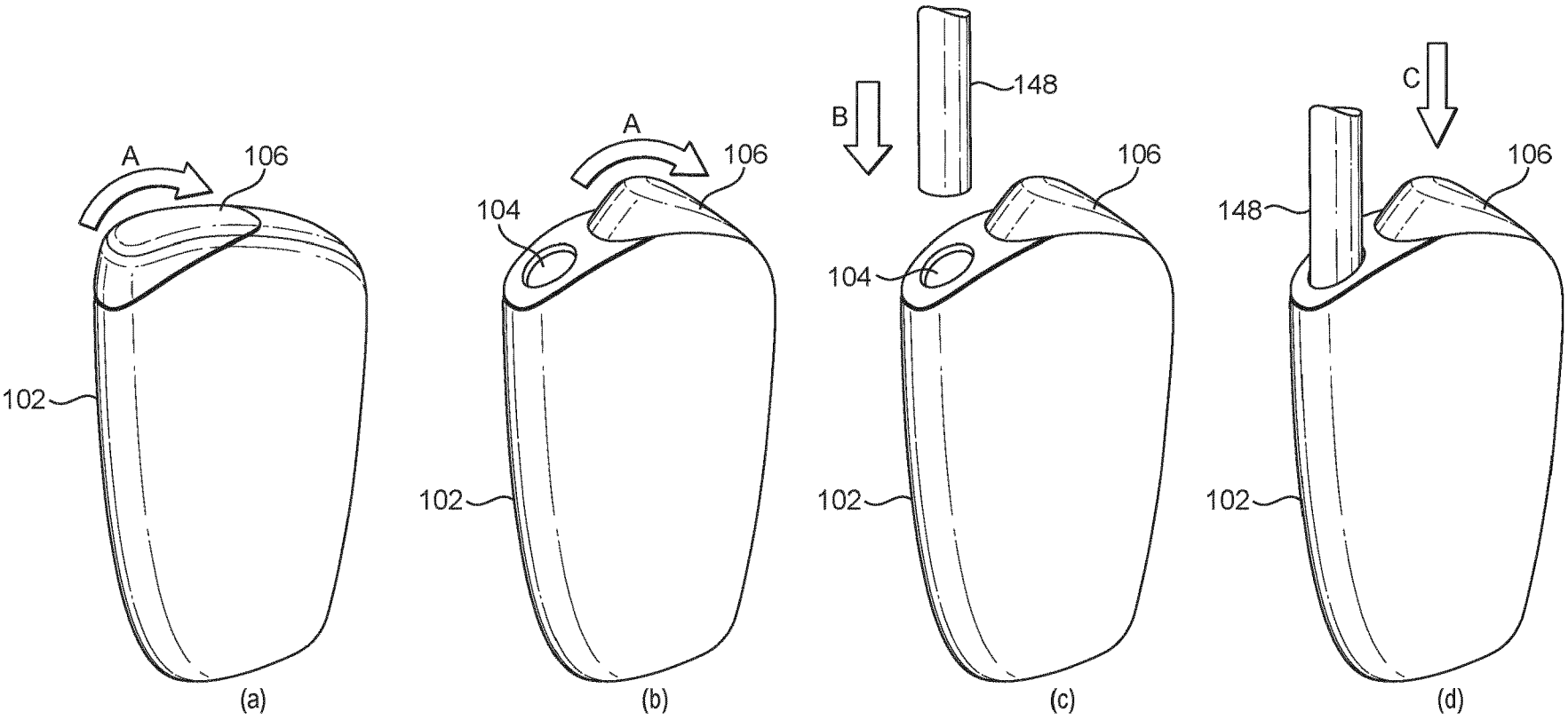
FIG. 4 shows arrangements of the first embodiment of the aerosol generation device during use.
Figure 5:
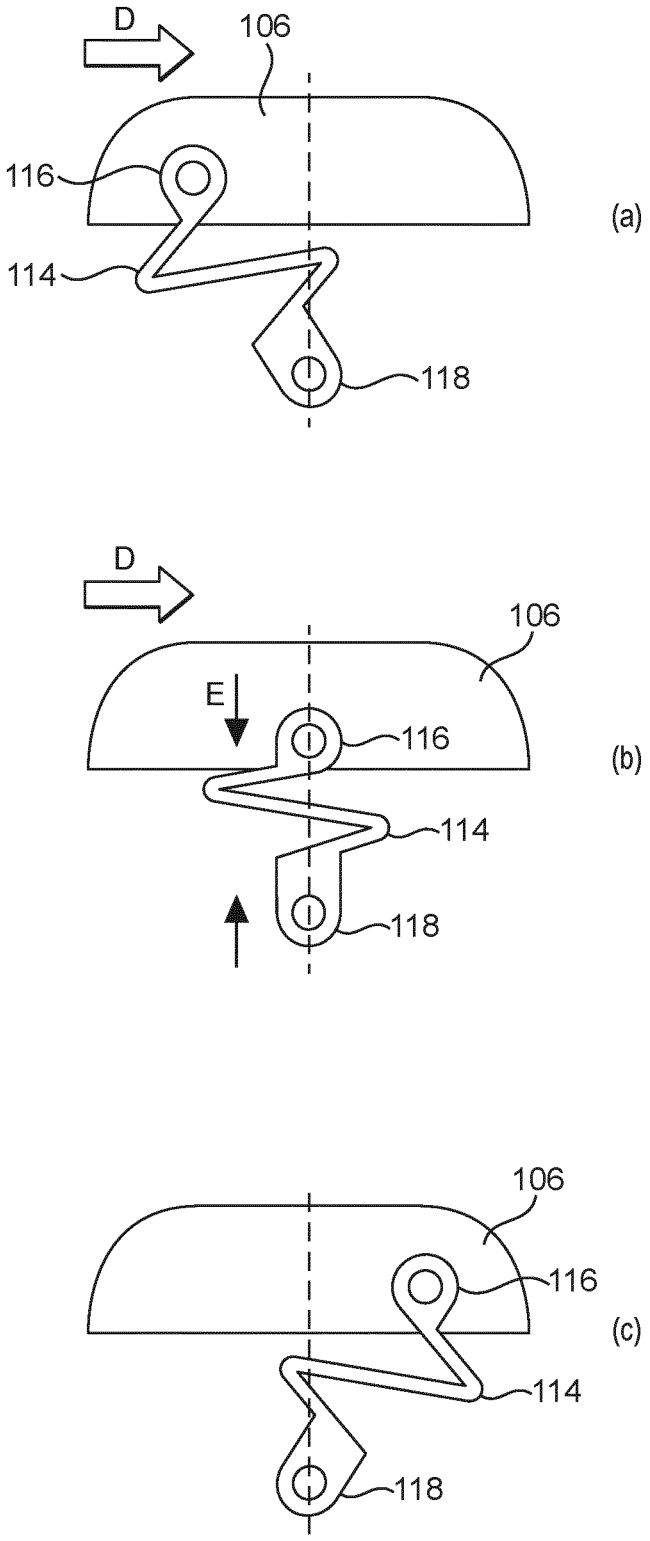
FIG. 5 illustrates the operation of a resilient element that forms a part of the first embodiment of the closure.

Referring to FIGS. 3 to 5, the operation of the closure 106 is described. FIG. 5 illustrates the forces exerted by the resilient element 114 and on the closure 106 in an embodiment of the aerosol generation device 100 that uses a linear compression spring which pivots around its second end 118. It will be appreciated that similar forces are exerted in his example by the resilient element 114 and on the closure 106 as they are in the first embodiment, where the resilient element 114 is a torsion spring. FIG. 5 therefore represents a generalisation of the device with a resilient element 114 which might not necessarily be a torsion spring.

Some embodiments of the aerosol generation device 100 do not have an activation position. In such embodiments, the closure 106 moves between an open and a closed position, for example along a straight or curved path. Nevertheless, the resilient element 114 being biased in the manner described herein can provide a smooth and comfortable feeling for a user as they slide the closure 106. For example, the biasing provided by the resilient element 114 causes the movement pin 136 to run along the guide 120, being biased towards the upper edge of the guide 120. It is common for the guide 120 to have a gap a little larger than the diameter of the movement pin 136, in order that the motion of the movement pin 136 along the guide 120 is smooth and unobstructed. In such cases, the user will note that, due to the biasing of the resilient member 114, the closure 106 has a pleasing gliding feeling with a small degree of transverse motion possible by acting against the biasing force.

Typically, the aerosol generation device 100 starts in the closed position to prevent the ingress of undesired material into the heating chamber 134. When the user wishes to use the aerosol generation device 100, the user exerts a force on the external cover 112 which acts to move the closure 106 towards the open position.

More specifically, the user applies an opening force (e.g. to the right in FIGS. 5*a-c*) on the external cover 112 of the closure acting to move the closure 106 in an opening direction (A) in the direction of the open position from the closed position. The opening force is initially resisted by the resilient element 114, as shown in FIG. 5*a*, so that if the user releases the closure 106 before it has moved beyond the first range of positions, the closure 106 returns to the closed position.

As the user applies the opening force on the closure 106, the first end 116 of the resilient element 114 moves in a first direction (D) from the closed position towards the open position and eventually the first end 116 reaches the equilibrium point, as shown in FIG. 5*b*. Once the first end 116 of the resilient element 114 passes the equilibrium point, as shown in FIG. 5*c*, the force exerted by the resilient element 114 acts to move the closure 106 towards the open position.

As the first end 116 of the resilient element 114 moves in the first direction (D), the resilient element 114 is deformed in the second direction (E). The second direction, and/or a component of the second direction (E) is transverse to the first direction (D), so that, for example, as the closure 106 moves horizontally from the closed position to the open position, the resilient element 114 is deformed vertically.

It will be appreciated that the second direction (E) may not be entirely transverse to the first direction (D), e.g. the second direction (D) may be transverse to a component of the first direction (D) and aligned with a component of the first direction (E).

Typically, as the closure 106 moves between the closed position and the open position, the first direction (D), that is the direction of movement of the first end 116 of the resilient element 114, is the same as the opening direction (A), that is the direction of movement of the closure 106. Once the closure 106 has reached the open position, the closure 106 is met by the end of the guide 120, which prevents further movement of the closure 106.

With the closure 106 in the open position, the user inserts an aerosol substrate 148 into the heating chamber 108 via the aperture 104. More specifically, a first end of the aerosol substrate 148 is inserted in an insertion direction (B) into the heating chamber 108 while a second end of the aerosol substrate 148 remains external to the aerosol generation device 100 and is thereby accessible to the user.

In embodiments where the aerosol generation device 100 has an activation position, with the aerosol substrate 148 located in the heating chamber 108, the user moves the closure 106 in an activation direction (C) towards the activation position. In this embodiment, the user moves the closure 106 towards the body 102 of the aerosol generation device 100. As the closure 106 moves towards the body 102, the movement pin 136 moves along the sensor guide 144 and depresses the push button of the activation detector 146. The depression of the push button operates an activation signal that (directly or indirectly) results in the operation of the heater. The heater heats the heating chamber 108 and thereby heats the aerosol substrate 148. The heating of the aerosol substrate 148 produces a vapour, which the user is then able to inhale through the exposed end of the aerosol substrate 148. In embodiments without an activation position, the user typically operates another control means to activate the heater, such as pressing a button placed on the aerosol generation device 100.

The resilient element 114 acts to bias the first movement pin 136 away from the activation position towards the open position, so that the user is required to maintain pressure on the external cover 112 in order to keep the closure 106 in the activation position.

Once the aerosol substrate 148 has heated sufficiently, the user may remove pressure from the closure 106. Once the pressure is removed, the force exerted by the resilient element 114 acts to move the movement pin along the sensor guide 144 away from the activation detector 146 and the push button rises. This may send a deactivation signal, or cease the sending of the activation signal, to stop operation of the heater.

While inhaling the vapour, the user may repeatedly depress and release the external cover 112 to move the closure 106 between the open position and the activation position so as to turn the heater on and off.

In some examples, the user may not need to hold the closure 106 in the third position (or in examples where no third position is present, may not need to hold the button down or continually trigger the other activation means) for the full heating cycle in order to activate the device 100. Instead, the device 100 may be configured to detect that the closure 106 has merely entered the third position (or the button or other means has been triggered) or has been held there for a time period less than the time of a full heating cycle, and upon detection of this the full heating cycle will commence. This arrangement takes fine control out of a user's hands, and reduces the chance that an inexperienced user will hold the heater on for too long and overheat the aerosol substrate 148.

When the user has exhausted the aerosol substrate 148, the user removes the aerosol substrate 148 from the heating chamber 108 and disposes of the aerosol substrate 148. The user then applies a closing force on the external cover 112 of the closure 106 in the direction of the closed position from the open position (e.g. to the left in FIGS. 5*a-c*). The closing force is initially resisted by the resilient element 114, as shown in FIG. 5*c*, so that if the user releases the closure 106 before it has moved substantially, the closure 106 returns to the open position.

As the user continues to apply the closing force on the external cover 112 of the closure 106, the first end 116 of the resilient element 114 eventually reaches the equilibrium point, as shown in FIG. 5*b*. Once the first end 116 of the resilient element 114 passes the equilibrium point, as shown in FIG. 5*a*, the force exerted by the resilient element 114 acts to move the closure 106 towards the closed position. This process is broadly the reverse of the motions described above for moving the closure 106 from the closed position to the open position.

When the closure 106 is in the closed position, the aerosol generation device 100 can be stowed, for example in a bag or a pocket, and the closure 106 prevents the ingress of material into the heating chamber 108. The resilient element 114 biases the closure 106 towards the closed position to prevent the closure 106 from moving due to incidental contact with other objects.

Second Embodiment

Figure 6:
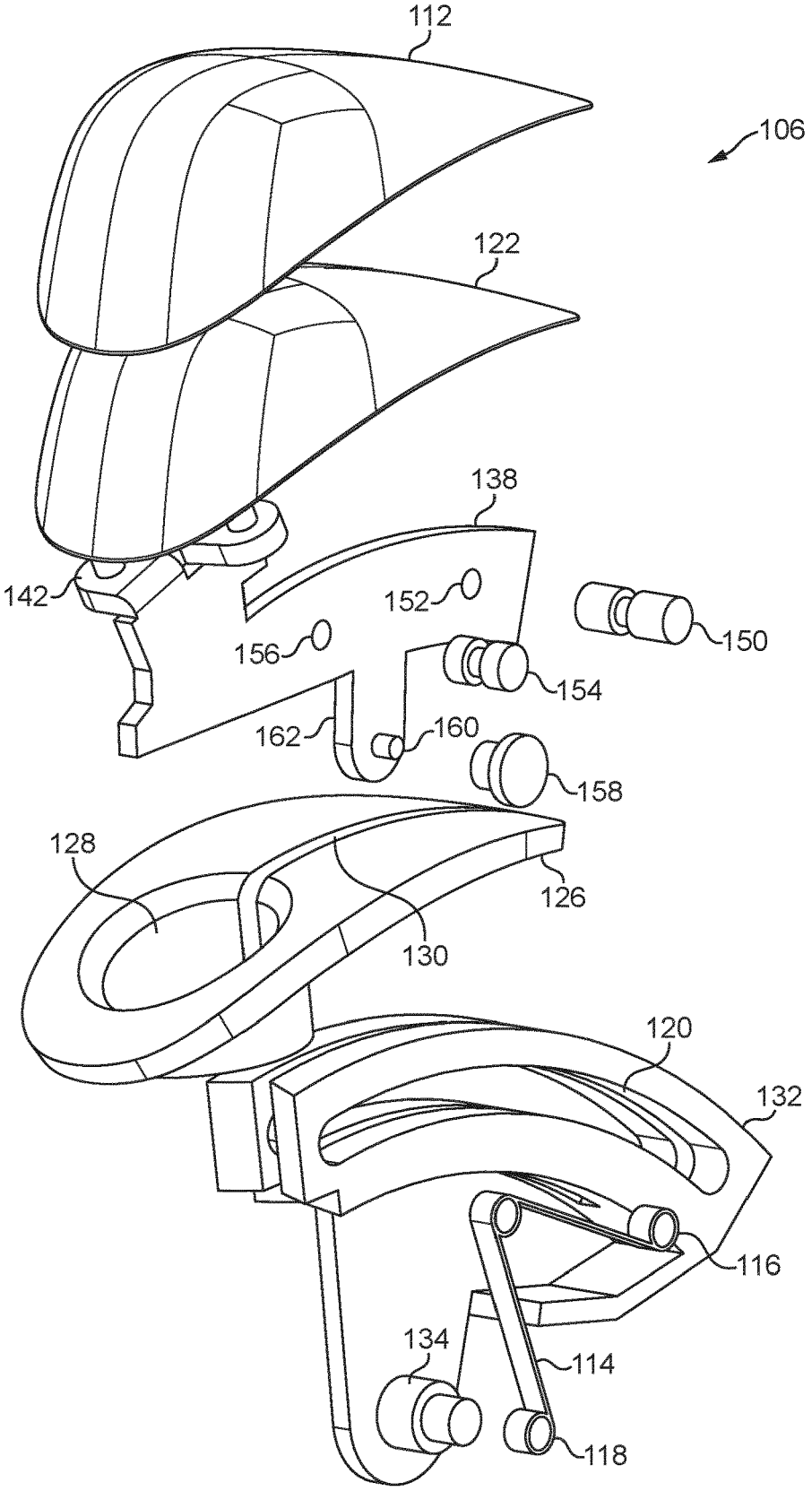
FIG. 6 is a component view of a closure of the aerosol generation device according to a second embodiment of the disclosure.

Referring to FIG. 6, an aerosol generation device 100 according to a second embodiment of the closure 106 is identical to the aerosol generation device 100 of the first embodiment, described with reference to FIGS. 1 to 5, except that the linkage 138 of the second embodiment differs from that of the first embodiment. In the second embodiment, the linkage 138 comprises a main body section, a prong 162 that extends from one side of the body of the linkage 138 and a guard attachment 142 that extends from the other side of the body of the linkage 138. The linkage 138 is sized so that the body of the linkage 138 and the prong 162 of the linkage 138 are able to pass through the channel 130 of the aperture cover 126.

The linkage 138 further comprises: a first pin 150, a second pin 154 and a third pin 158; and a first pin hole 152, second pin hole 156, and a third pin hole 160. The first pin 150 is arranged to fit into the first pin hole 152, the second pin 154 is arranged to fit into the second pin hole 156, and the third pin 158 is arranged to fit into the third pin hole 160. The first pin hole 152 and the second pin hole 156 are arranged on the main body of the linkage 138; the third pin hole 160 is arranged on the prong 162 of the linkage 138.

The guard attachment 142 is arranged to attach the guard 122 to the linkage 138. Another difference from the first embodiment is that in this embodiment the guard attachment 142 contains resiliently deformable snap fit elements that are pushed into the guard 122. As a result, in this embodiment there is no guard aperture. In some embodiments, the guard attachment 142 comprises screws, adhesives, or other attachment means.

The first pin 150 and the second pin 154 are sized so that they can pass through the guide 120. Typically, the first pin 150 and the second pin 154 are arranged to fit snugly within the guide, this avoids undesirable rattling of the closure 106 when the linkage 138 is secured inside the guide component 132.

The linkage 138 is arranged to be insertable into the guide component 132, with the prong 162 internal to the body 102 and pointing away from the external cover 112. With the linkage 138 inserted into the guide component 132, the main body of the linkage 138 is between the two guide components so that the first pin 150 can be inserted through the first guide section, through the first pin hole 152, and then through the second guide section. Similarly, the second pin 154 can be inserted through the first guide section, through the second pin hole 156, and then through the second guide section. Thereby, the linkage 138 is secured within the guide component 120 and movement of the external cover 112 causes, via the guard 122, movement of the first pin 150 and the second pin 154 along the guide 120. The movement is opposed (or helped) by a force exerted by the resilient element 114 as has been previously described.

To assemble the closure 106 of the second embodiment, the guide component 132 is placed inside the body 102 of the aerosol generation device 100. The linkage 138 is connected to the guard 122 using the guard attachment 142. The linkage 138 is then passed through the channel 130 of the aperture cover element 126 so that the first pin hole 152 and the second pin hole 156 coincide with the guide 120 of the guide component 132 of the second embodiment. The first end 116 of the resilient element 114 is then arranged so that it coincides with the third pin hole 160. The first pin 150, second pin 154, and third pin 158 are respectively placed in the first, second, and third pin holes 152, 156, 160. The pins 150, 154, 158 extend from the guide 120 so that they overlap with the edges of the guide 120 and prevent removal of the linkage 138 through the channel 130 of the aperture cover 126. The guard 122 is connected to the first end 116 of the resilient element 114 via the third pin 158 of the linkage 138.

The user is thus able to move the first end 116 of the resilient element 114 by moving the external cover 112 of the closure 106.

Figure 7:
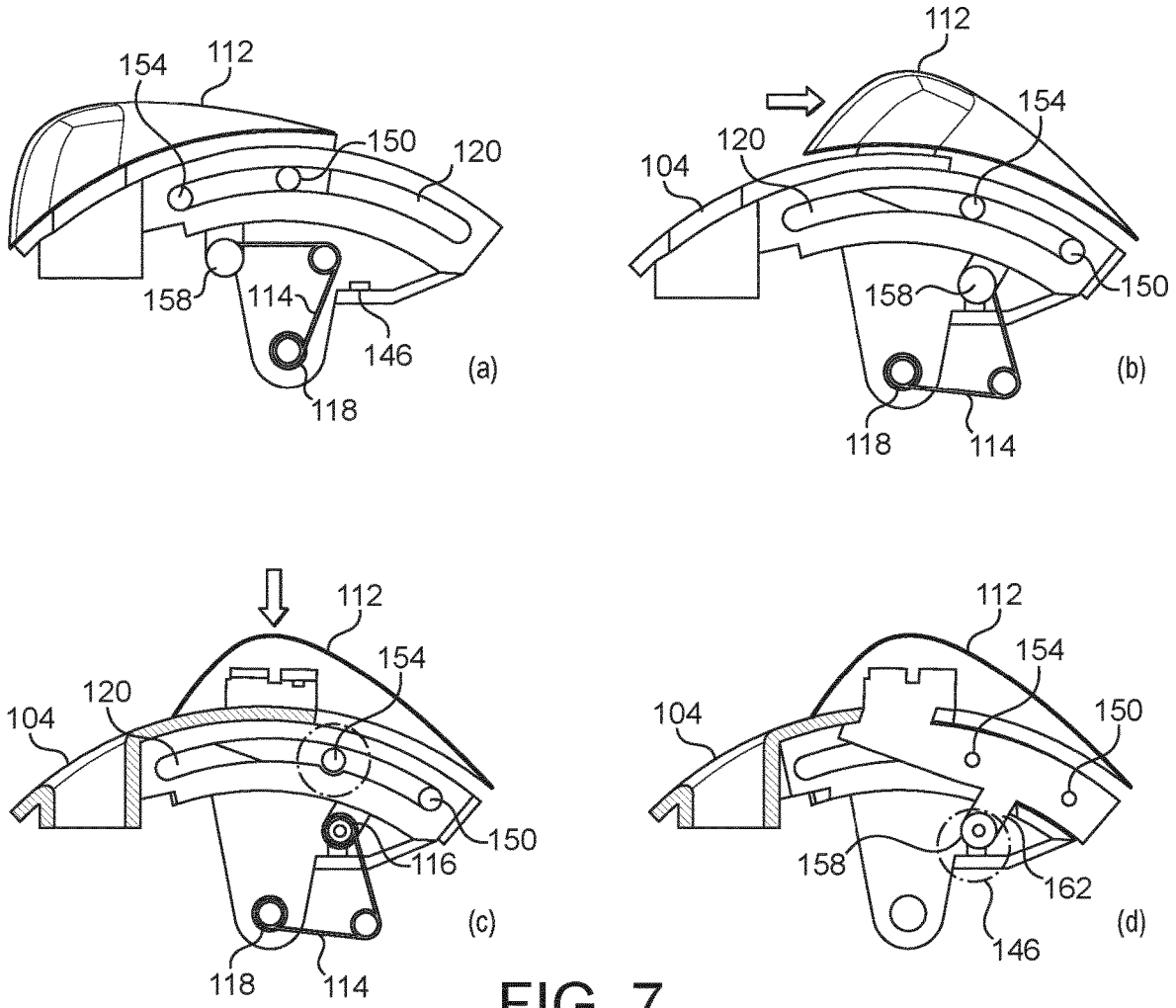
FIG. 7(*a*) is a schematic cross-sectional view from the side of the second embodiment of the closure, where the closure is in a closed position.

Referring to FIG. 7, the closure 106 of the second embodiment is shown in the closed position (FIG. 7*a*), the open position (FIG. 7*b*), and the activation position (FIGS. 7*c* and 7*d*). In the second embodiment, the first end 116 of the resilient element 114 interacts with the closure 106 via the third pin 158.

Specifically, as the closure 106 moves from the closed position to the open position, the first pin 150 and the second pin 154 move along the guide 120. As the first pin 150 and the second pin 154 move along the guide, the first end 116 of the resilient element 114 moves between the first position and the second position.

The prong 162 of the linkage 138 is arranged to be located adjacent the activation detector 146 when the closure 106 is in the open position. As the closure 132 is depressed to reach the activation position, the prong 162 is arranged to depress the activation detector 146 in order to operate the activation signal.

Third Embodiment

Figure 8:
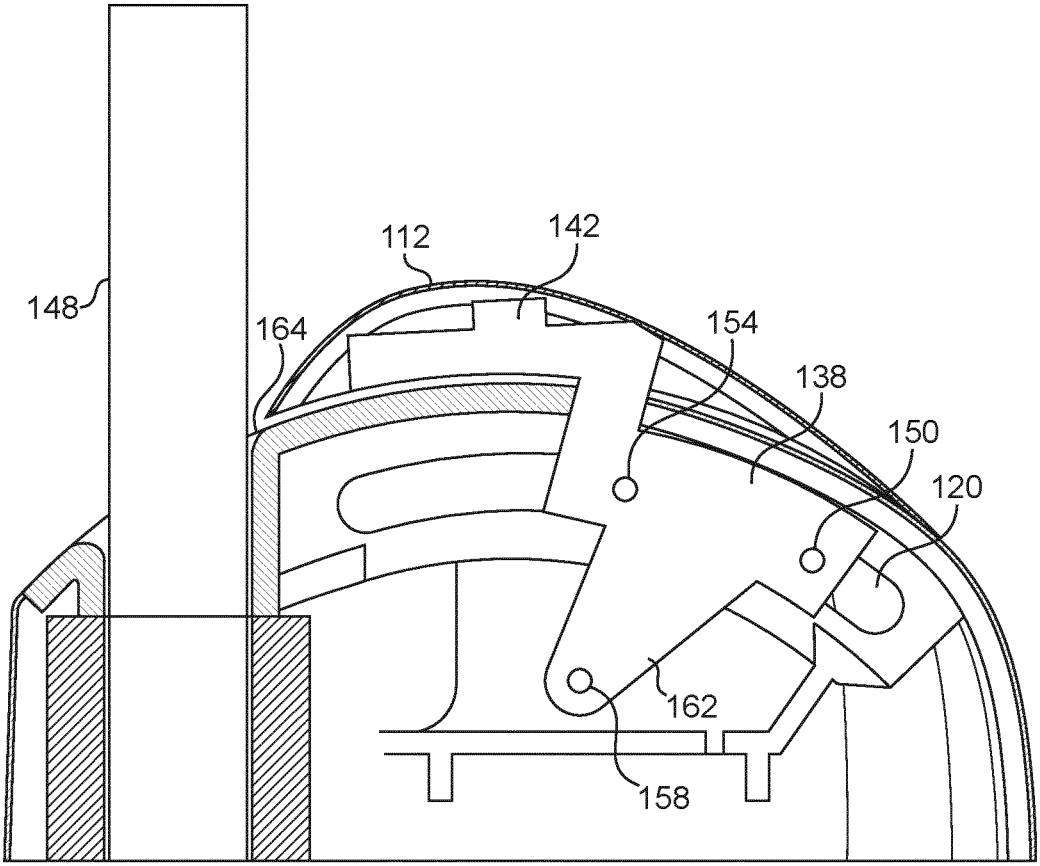
FIG. 8 is a cross-sectional view from the side of a third embodiment of the closure.

Referring to FIG. 8, an aerosol generation device 100 according to a third embodiment of the closure 106 is identical to the aerosol generation device 100 of the second embodiment, described with reference to FIGS. 6 to 7, except that the linkage 138 comprises a guard attachment 142 arranged to be attached, via the channel 130, near the end of the guard 122 that is furthest from the aperture 104. Typically, the guard attachment 142 of the third embodiment also runs along a substantial portion of the guard 122 to ensure a firm connection.

The guard attachment 122 is arranged to pass through the channel 130 so that it can be attached to the guard 122, which is external to the body 102 of the aerosol generation device 100. As the guard attachment 122 is arranged to be attached to the end of the guard 122 furthest from the aperture 104, when the closure 106 is in the closed position, the guard attachment 142 is offset from the aperture 104, while the external cover 112 extends over the aperture 104.

This offset enables the aerosol generation device 100 to comprise a separator 164; the separator 164 physically separating the aperture 104 from the channel 130. The separator 164 prevents the ingress of materials into the heating chamber 108 via the channel 130.

The separator 164 is typically an integral part of the body 102 and/or the heating chamber 108. Typically, the formation of the heating chamber 108 comprises deep drawing, where the aperture 104 is formed by deformation of an originally flat sheet by a drawing die; thus the separator 164 is a part of the original sheet and so is integral to the heating chamber 108.

Fourth Embodiment

Figure 9:
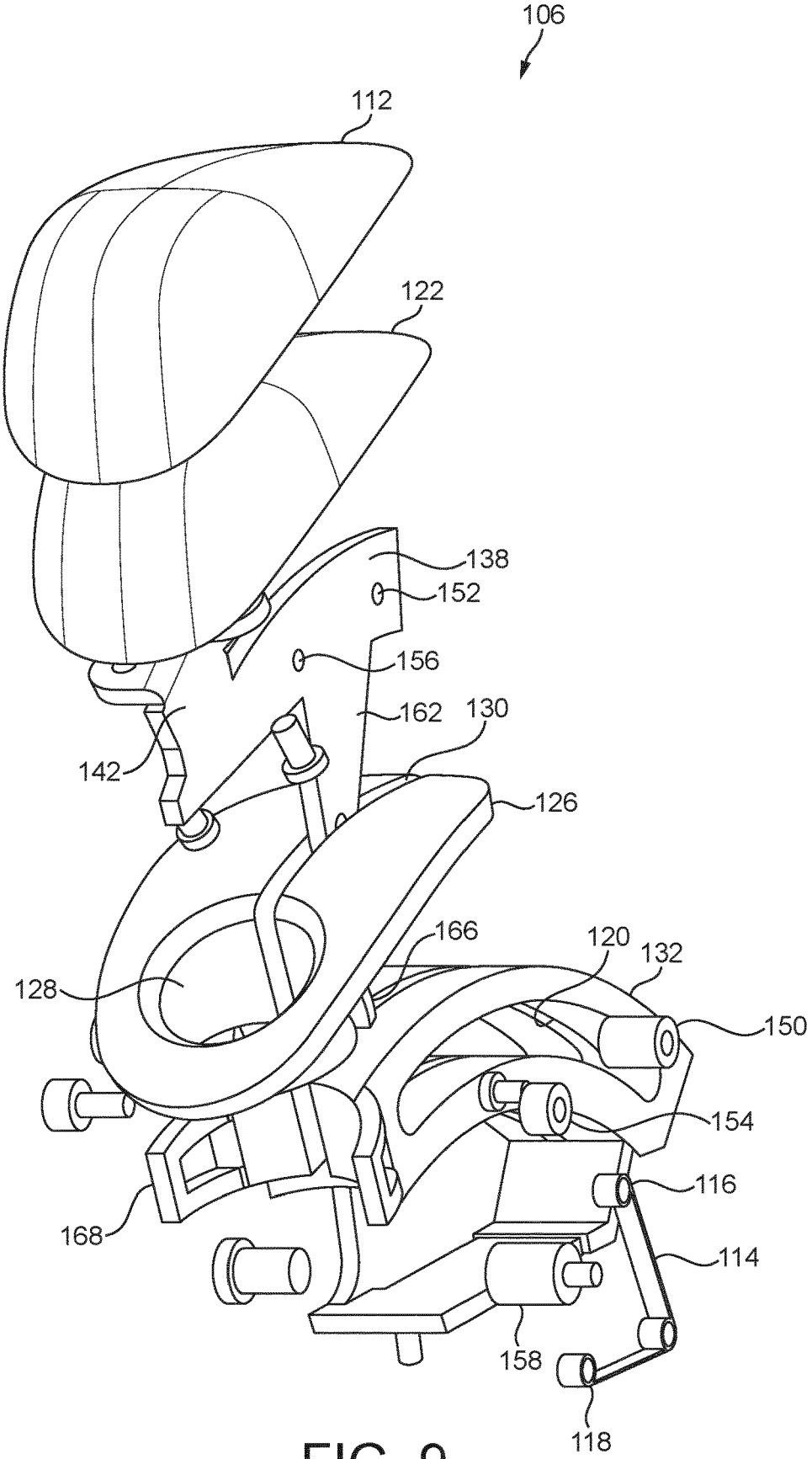
FIG. 9 is a component view of a closure of the aerosol generation device according to a fourth embodiment of the disclosure.
Figure 10:
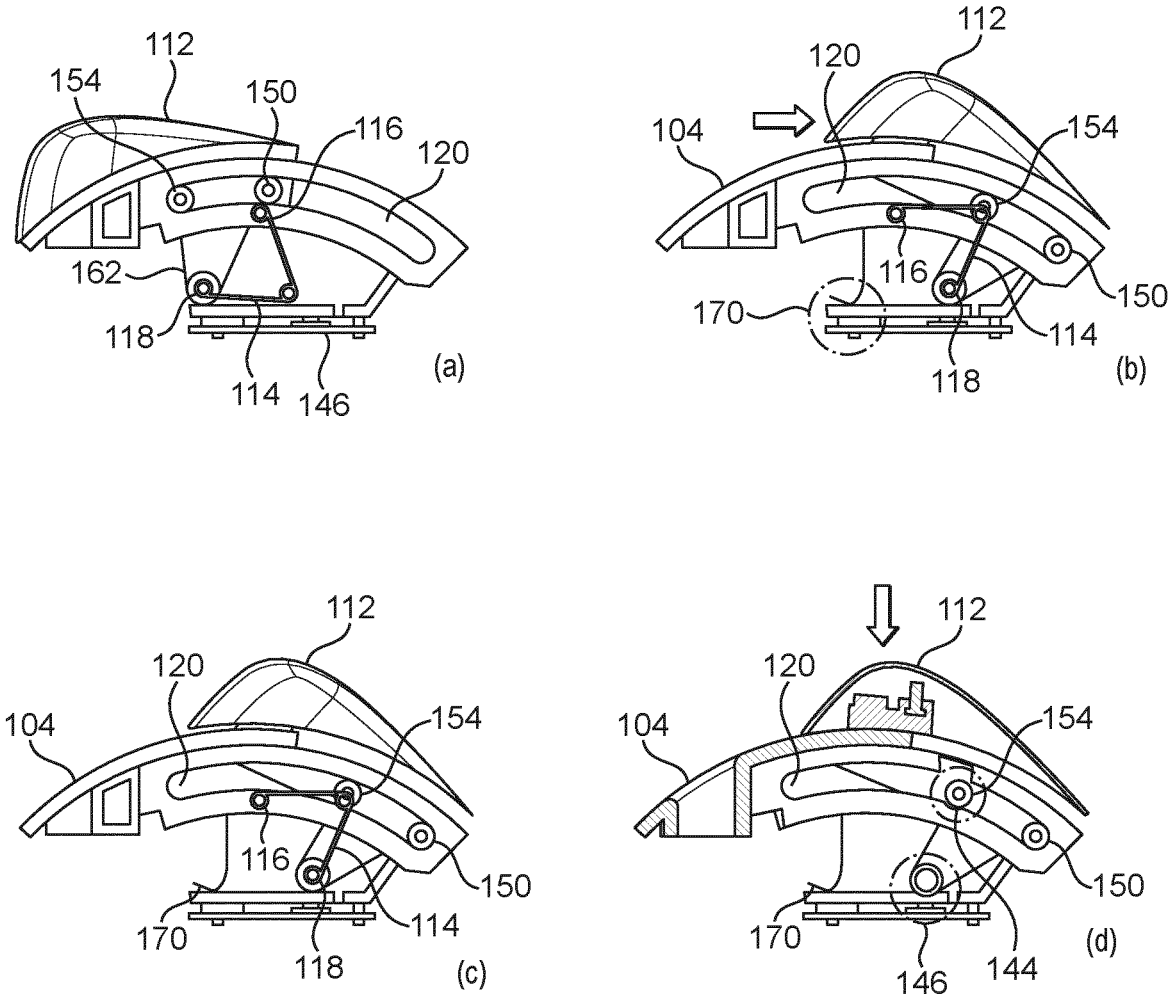
FIG. 10(*a*) is a schematic cross-sectional view from the side of the fourth embodiment of the closure, where the closure is in a closed position.

Referring to FIG. 9, an aerosol generation device 100 according to a fourth embodiment of the closure 106 is identical to the aerosol generation device 100 of the second embodiment, described with reference to FIGS. 6 to 7, except that the prong 162 of the linkage 138 of the fourth embodiment is not perpendicular to the main body of the linkage 161. The prong 162 is instead angled towards the aperture 104. This enables an arrangement using a separator as is present in the third embodiment without changing the mounting position of the second end 118 of the resilient element 114 or extending the guide 120. The position of the intersection between the prong 162 and the main body of the linkage 138 (the "proximal" end of the prong 162) is changed as compared to the second embodiment, but the location of the "distal" end of the prong 162 in each position is unchanged.

Another difference of the fourth embodiment is that the aperture cover 126 further comprises a cover attachment mechanism 166.

Another difference of the fourth embodiment is that the guide component 132 further comprises extensions 168 from the main body of the guide component 132 that are arranged to interact with the cover attachment mechanism 166 of the aperture cover 126 to hold each component in place relative to each other. Typically, the cover attachment mechanism 166 and the extensions 168 comprise, respectively, protrusions and gaps, where the protrusions of the cover attachment mechanism 166 are arranged to fit into the gaps of the extensions 168.

Referring to FIGS. 10*a-d*, the fourth embodiment further comprises an opening detector 170, which is arranged so as to be operated as the closure 106 moves from the closed position to the open position. In this embodiment, the opening detector 170 is a tactile switch, which is depressed by the closure 106 when the closure 106 is in the closed position. In operation, as the closure 106 moves to the open position, the closure 106 moves away from the opening detector 170 so that when the closure 106 reaches the open position the tactile switch is uncovered and raised. The opening detector 170 is arranged to initiate a status signal once it has been uncovered and/or once it detects a movement of the closure 106, e.g. when the closure 106 is moved from the closed position to the open position. It will be appreciated that the opening detector may be another type of sensor, such as any one of the sensors described in FIGS. 16*a* to 16*d*.

Fifth Embodiment

Figure 11:
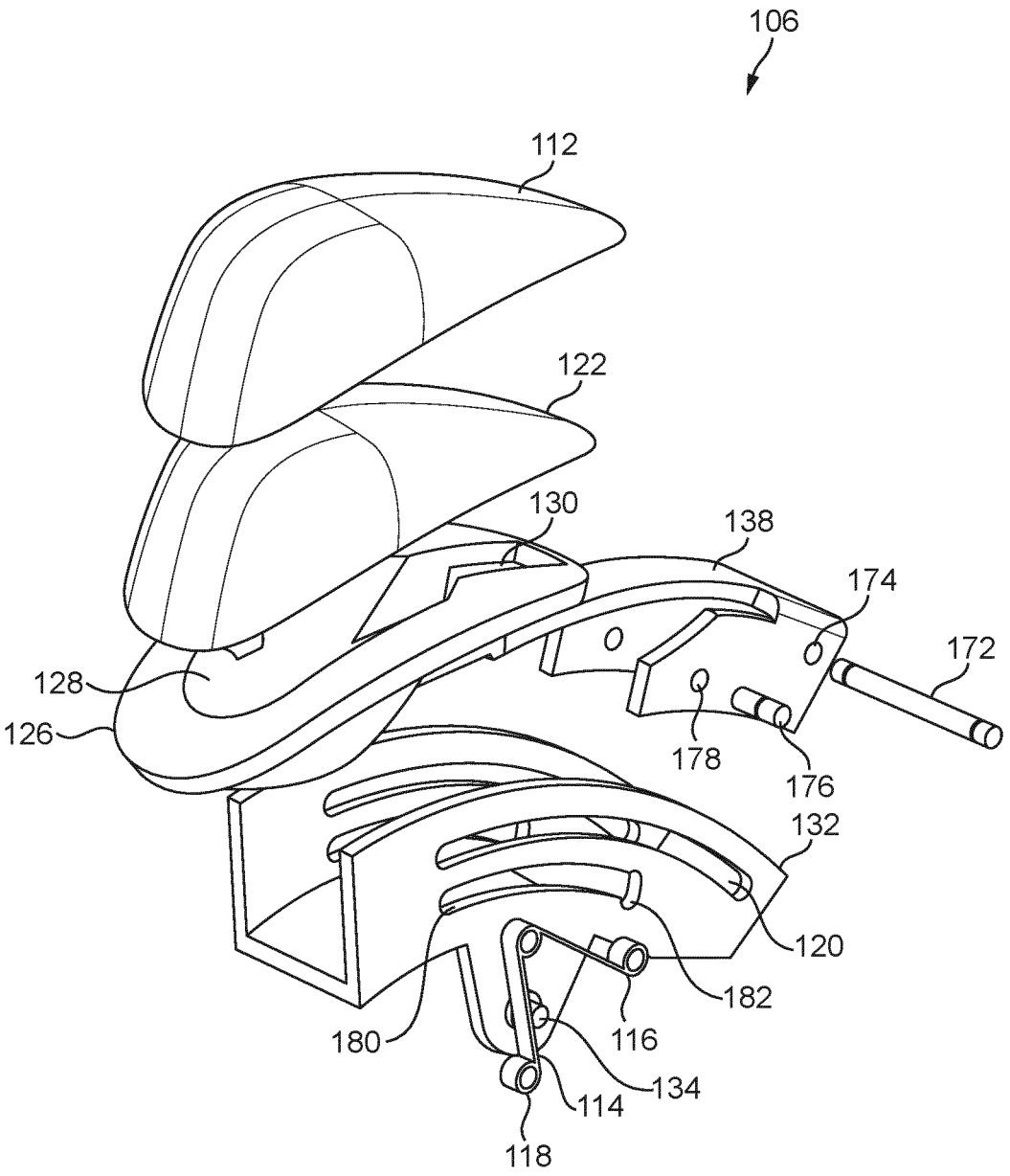
FIG. 11 is a component view of a closure of the aerosol generation device according to a fifth embodiment of the disclosure.

Referring to FIG. 11, an aerosol generation device 100 according to a fifth embodiment of the closure 106 is identical to the aerosol generation device 100 of the second embodiment, described with reference to FIGS. 6 to 7, except that the aperture cover 126 of the fifth embodiment comprises a comparatively wide channel 130.

Another difference of the fifth embodiment is that the guard attachment 142 of the linkage 138 comprises an extended prong that is arranged to pass along the channel 130 of the guard 122 and to connect to the base of the guard 122 via a snap fit mechanism. In the closed position, the guard attachment 142 covers the aperture 104, in the open position, the guard attachment 142 is offset so as to uncover the aperture 104.

Another difference of the fifth embodiment is that the linkage 138 of the fifth embodiment comprises a first pin 172 and a second pin 176 arranged to fit into a first hole 174 and a second hole 178 of the linkage 138.

Another difference of the fifth embodiment is that the guide element 132 further comprises a second guide 180 and a third guide 182. The third guide 182 is connected to the second guide 180 so that a component inserted into the second guide 180 is able to move from a first end of the second guide 180 to a second end of the second guide 180, where the second end of the second guide 180 is coincident with a first end of the third guide 182, and then from the first end of the third guide 182 to the second end of the third guide 182. The third guide 182 may be considered to be an activation guide, whereby the closure 106 is in the activation position when the third end is at the second end of the third guide 182.

The first end 116 of the resilient element 114 is arranged so as to be attachable to the second pin 176, which is arranged to align with the second guide 180 when the linkage 138 is inserted into the guide component 132. The second pin 176 is arranged to be insertable through the guide components of the guide 132 and through the second hole 178. The second pin 176 is in this way arranged to be moveable along the second guide 180 and the third guide 182.

Referring to FIG. 12*a*, in the fifth embodiment, in the closed position the resilient element 114 biases the closure 106 towards the closed position. The first end 116 of the resilient element 114 (which is attached to the second pin 176), is held at the first end of the second guide 180 by the resilient element 114.

Referring to FIG. 12*b*, in the open position, the first end 116 of the resilient element 114 (which is attached to the second pin 176) is held at the second end of the second guide 180, which is coincident with the first end of the third guide 182, by the resilient element 114.

Referring to FIGS. 12*c* and 12*d*, in the activation position, first end 116 of the resilient element 114 (which is attached to the second pin 176) is located at the second end of the third guide 182. At this position, the resilient element 114 is arranged so as to bias the first end 116 of the resilient element 114 away from the second end of the third guide 182 towards the first end of the third guide 182. In this way, the resilient element 114 is arranged to bias the closure 106 away from the activation position and towards the open position.

In the activation position, the activation detector 146 is depressed by the guard attachment 142, which is itself depressed by the user depressing the external cover 112 and the first end 116 of the resilient element 114 is at the second end of the third guide 182.

Sixth Embodiment

Figure 12:
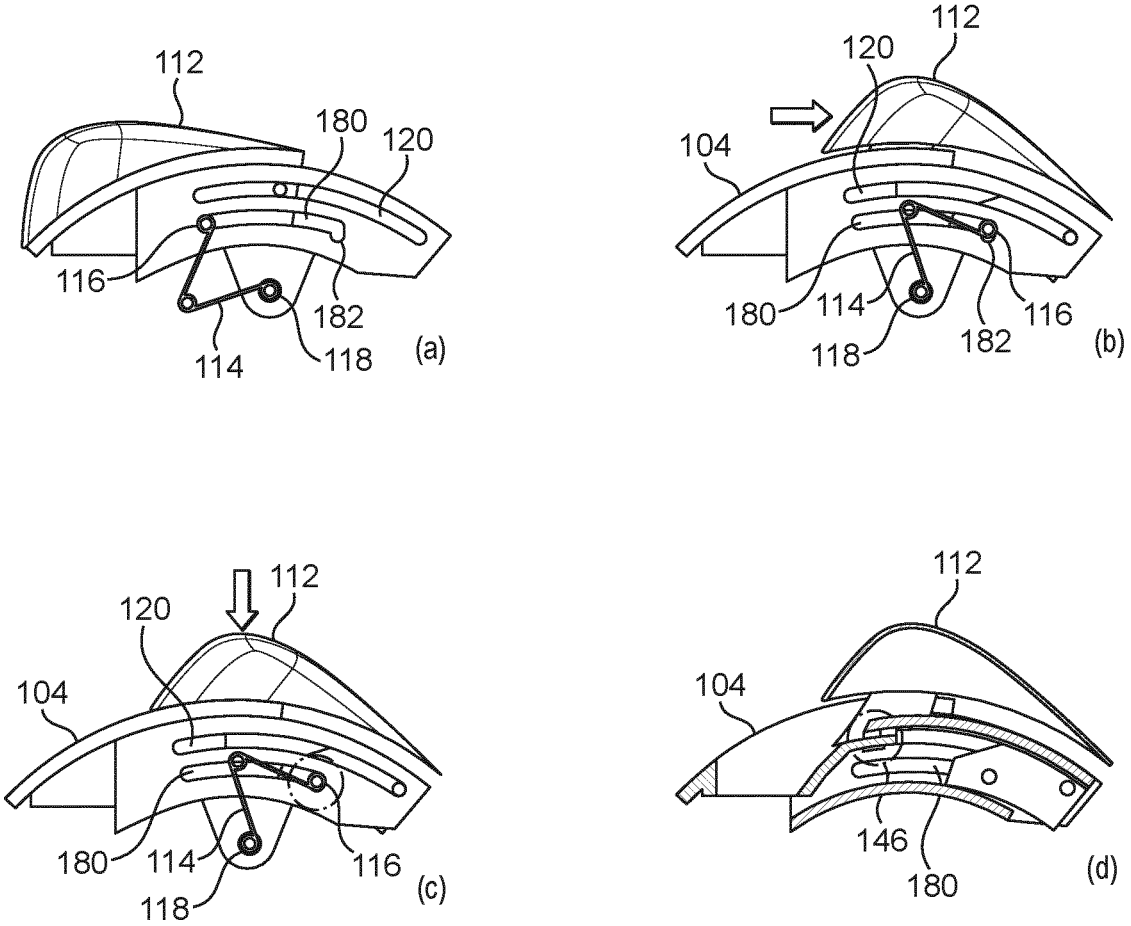
FIG. 12(*a*) is a schematic cross-sectional view from the side of the fifth embodiment of the closure, where the closure is in a closed position.
Figure 13:
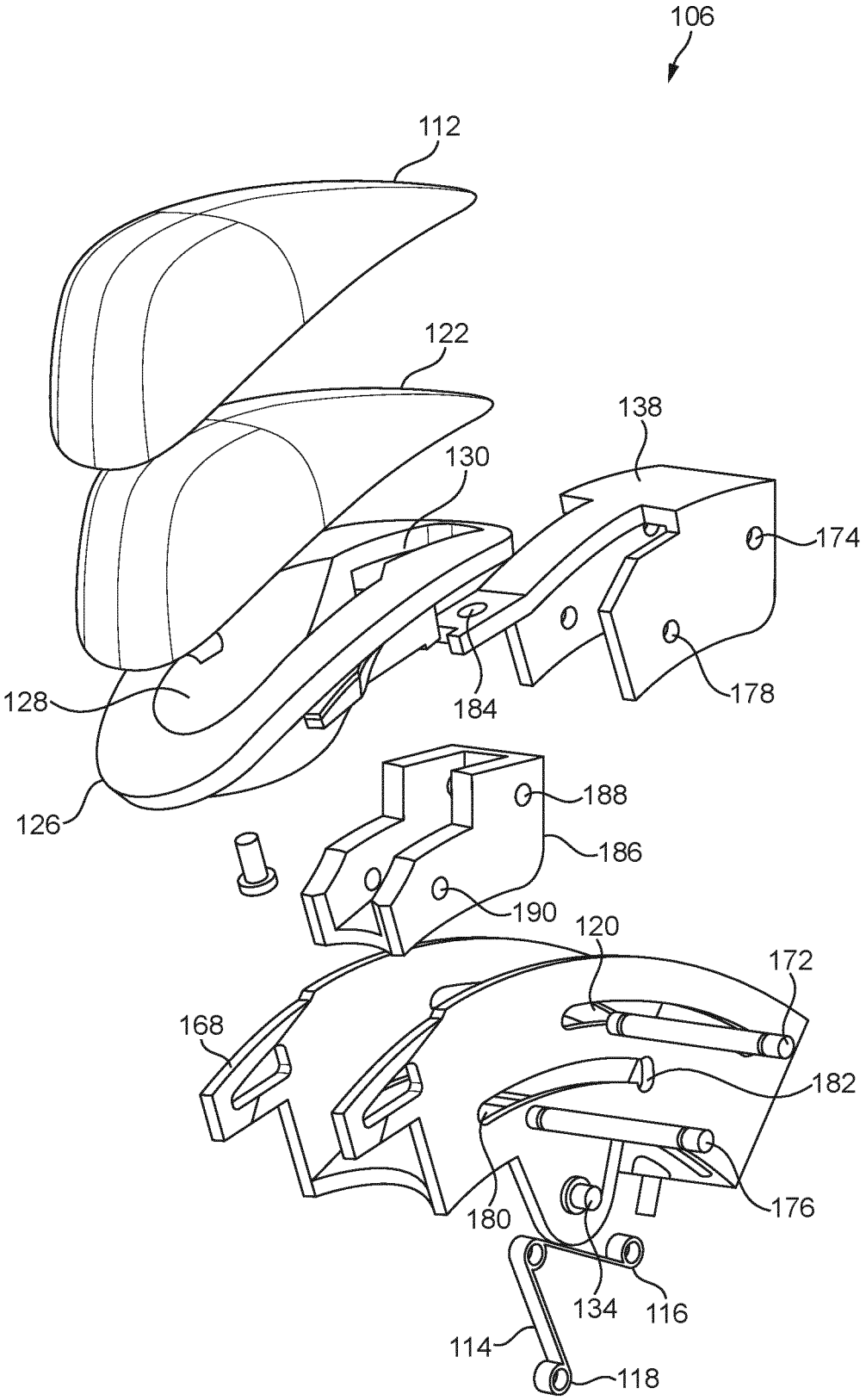
FIG. 13 is a component view of a closure of the aerosol generation device according to a sixth embodiment of the disclosure.

Referring to FIG. 13, an aerosol generation device 100 according to a sixth embodiment of the closure 106 is identical to the aerosol generation device 100 of the fifth embodiment, described with reference to FIGS. 11 to 12, except that the guard attachment 142 of the linkage 138 of the sixth embodiment comprises a screw arranged so as to fit through an aperture 184 located on the extended prong of the linkage 138. The guard mechanism comprises a corresponding thread in which the screw is received.

A further difference is that the sixth embodiment further comprises an intermediary component 186, which is arranged to fit inside the linkage 138. The intermediary component 186 contains the opening detector 170, typically in the form of a magnet that interacts with a corresponding Hall sensor located in the guide element 132. The intermediate component 186 comprises a first hole 188 and a second hole 190 arranged so that when the intermediate component 186 is inserted inside the linkage 138 the first hole 188 of the intermediate component 186 aligns with the first hole 174 of the linkage 138 and the second hole 190 of the intermediate component 186 aligns with the second hole 178 of the linkage 138. The use of the intermediate component 186 to contain the activation detector 146 enables relatively simple removal and maintenance of the activation detector 146 as well as simplifying the manufacture of similar closures that use different sensors, e.g. for different models of a product.

Figure 14:
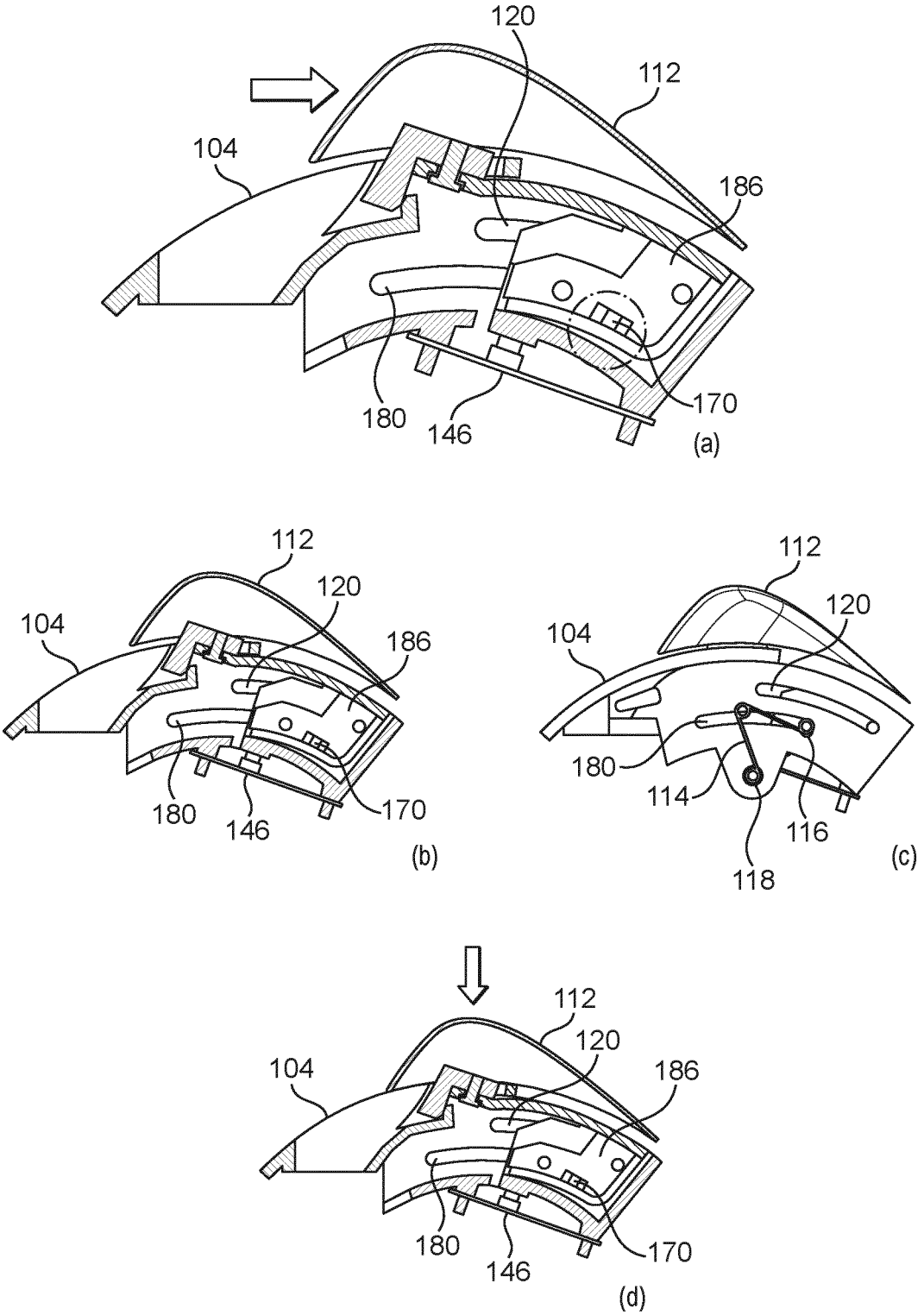
FIG. 14(*a*) is a schematic cross-sectional view from the side of the sixth embodiment of the closure, where the closure is in a closed position.

Referring to FIG. 14*a*, in the sixth embodiment, in the open position the intermediary component 186 is positioned so that the opening detector 170 is at a position that initiates a status signal. This typically comprises a magnet located in the intermediary component 186 being located proximate to a corresponding hall sensor.

Referring to FIG. 14*d*, in the activation position the intermediary component 186 is arranged so as to interact with the activation detector 146. Typically, this comprises a part of the intermediary component 186 depressing a tactile switch.

Figure 15:
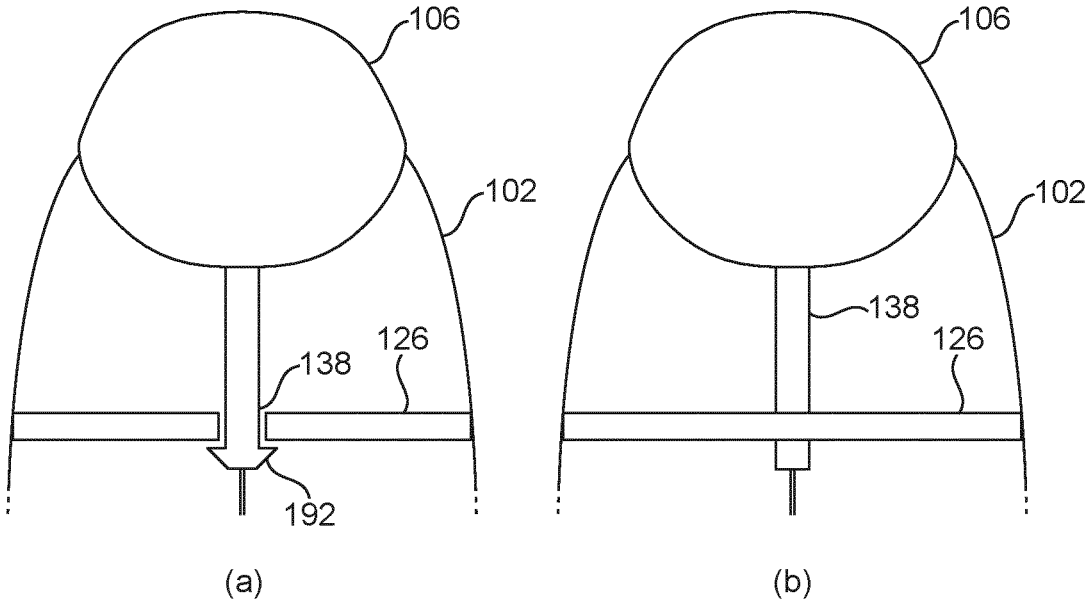
FIG. 15(*a*) is a view of a closure attachment mechanism for the closure.
Figure 16A:
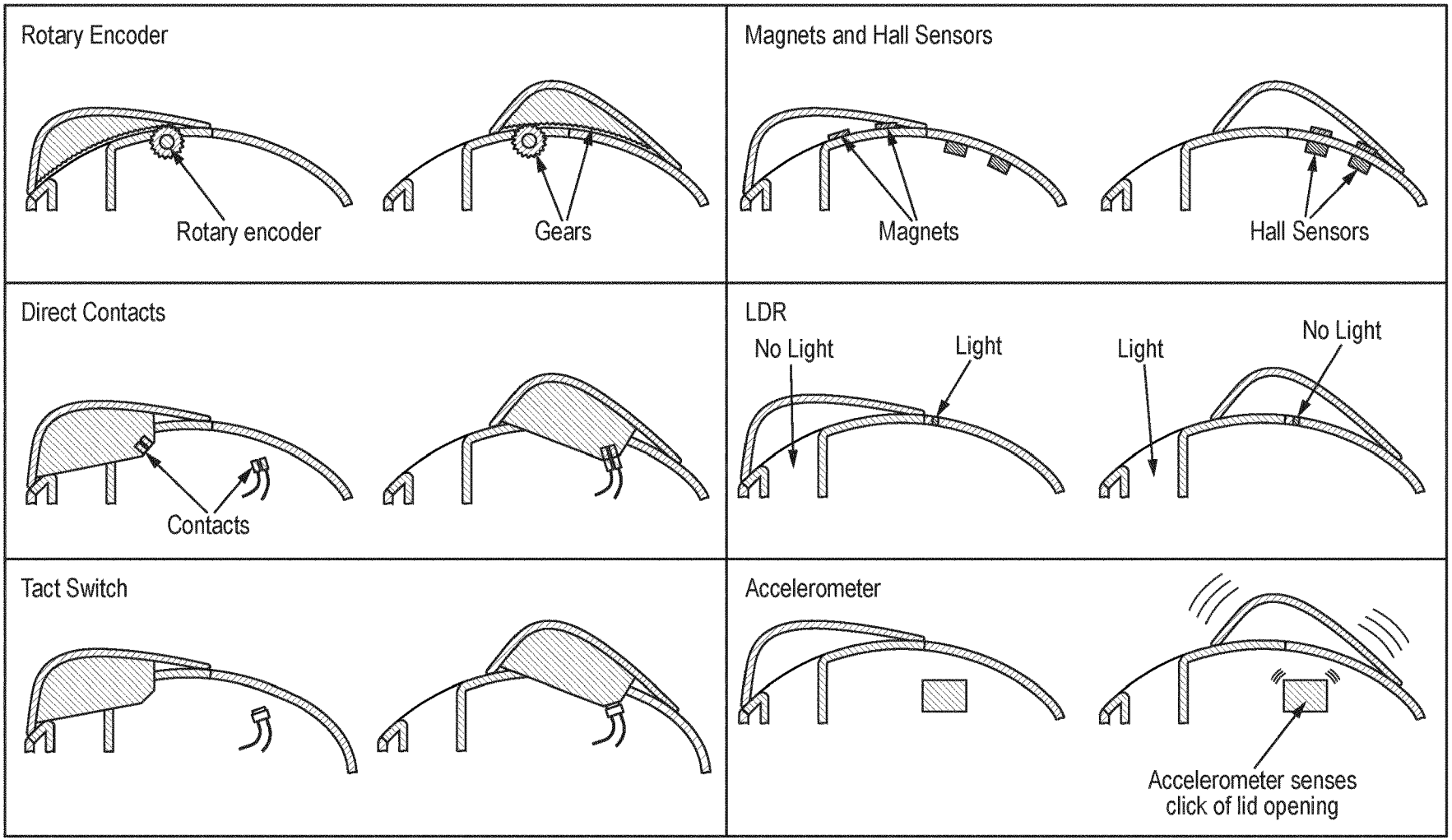
FIG. 16 is a view of sensors useable in various embodiments of the closure.
Figure 16B:
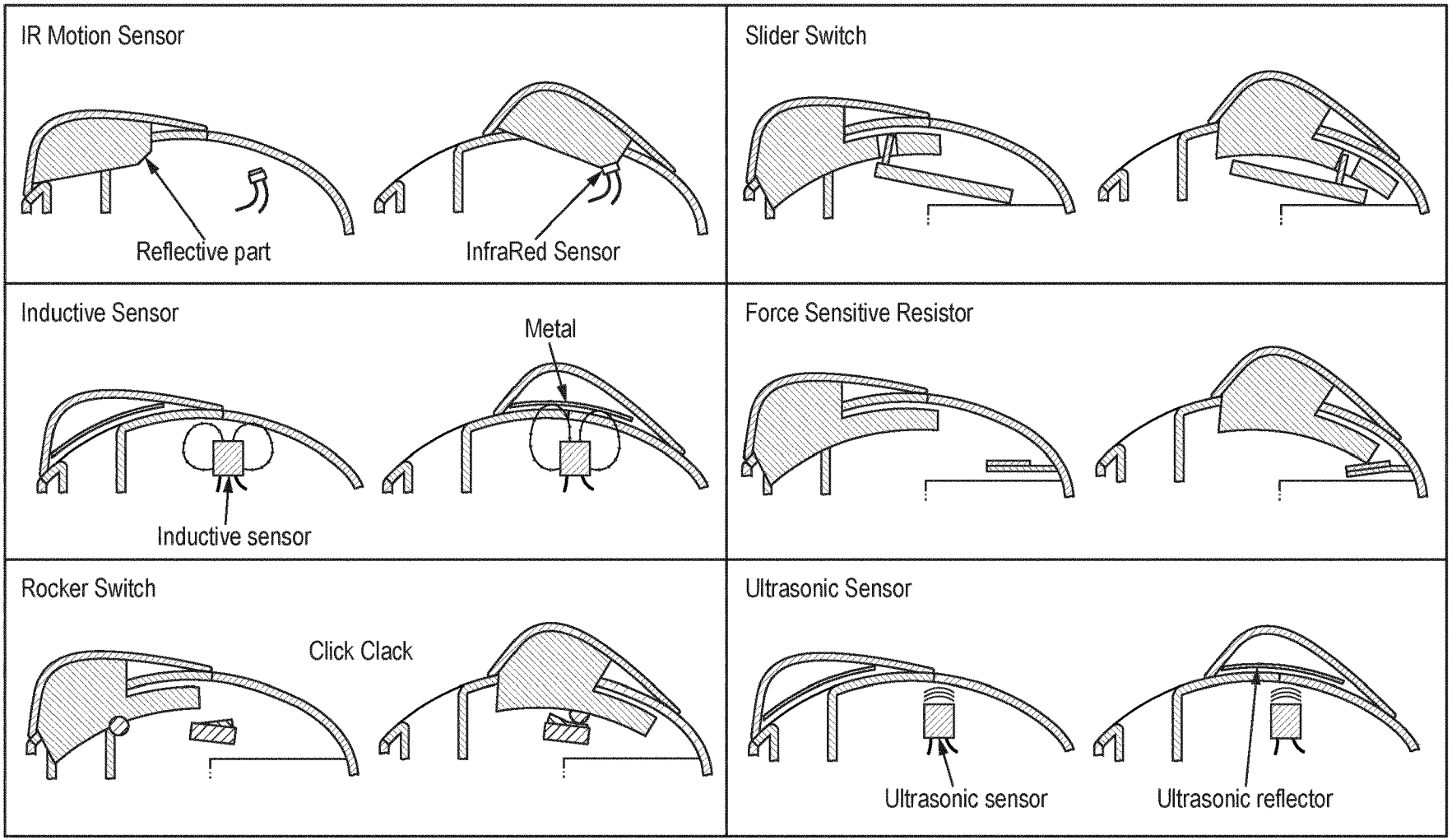
Figure 16C:
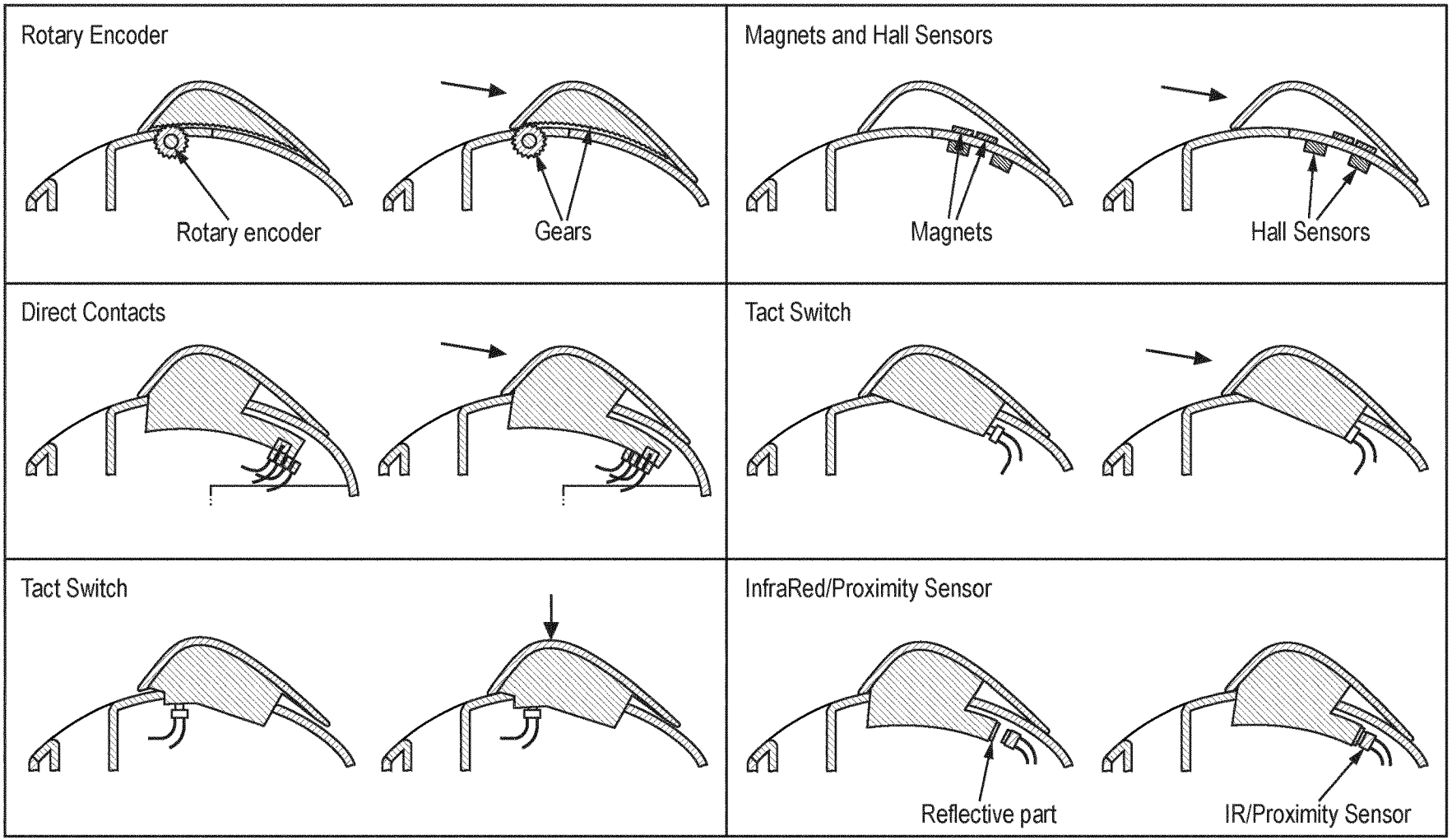
Figure 16D:
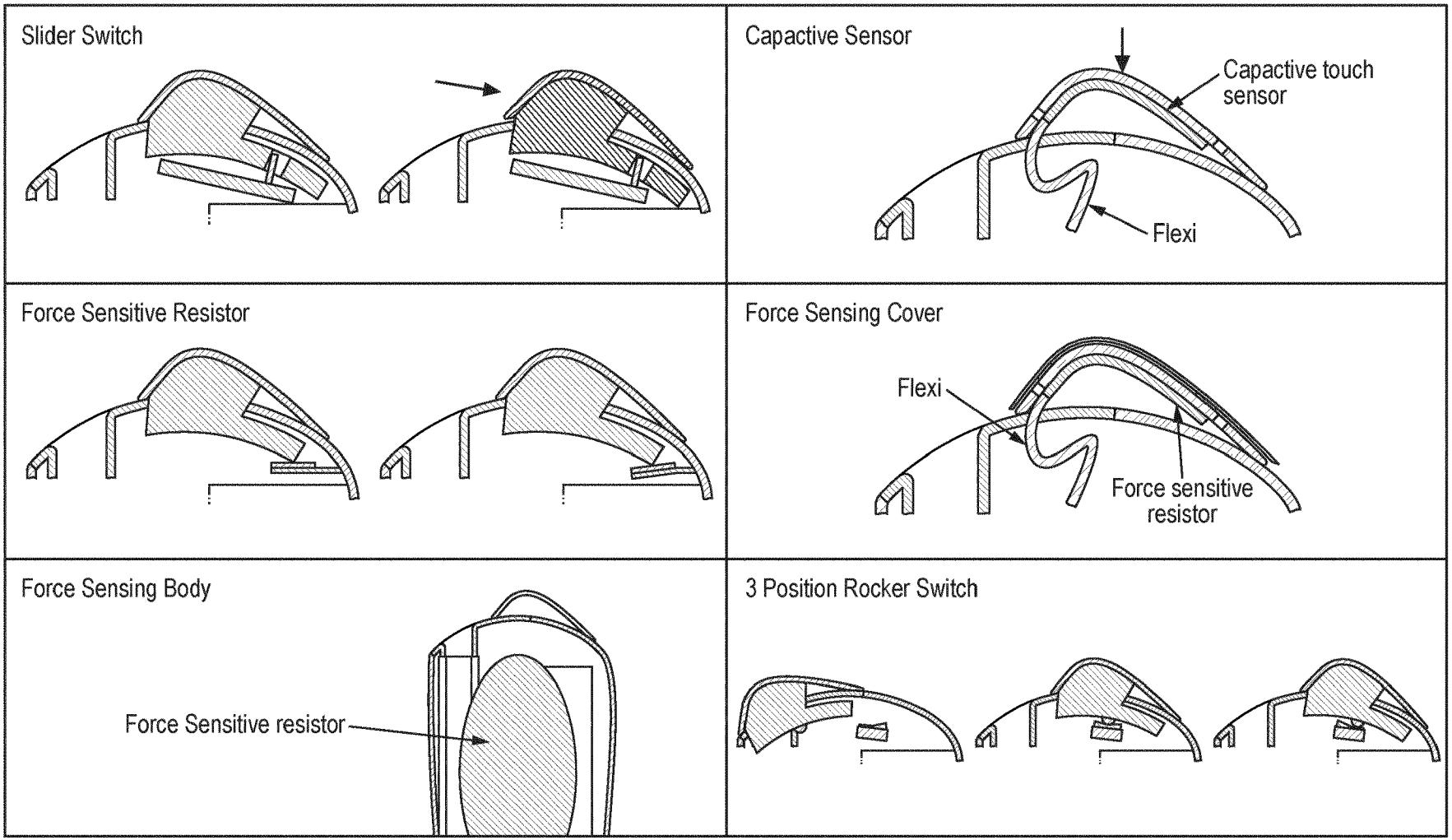

Referring to FIG. 15, in each embodiment described above, the external elements of the closure 106, e.g. the external cover 112, are attached to the internal elements of the closure 106, e.g. the resilient element 114, via the linkage 138 which passes through the channel 130 of the aperture cover 126.

Referring to FIG. 15*a*, in some embodiments the linkage 138 comprises a snap fit, where the base 192 of the linkage 138 is arranged to abut the base of the channel 130 of the aperture cover 126 to prevent removal of the base through the channel 130 of the aperture cover 126. In order to enable insertion of the base 192 of the linkage 138 through the channel 130 into the body 102 of the aerosol generation device 100, the base 192 is typically tapered and the base 192 and/or the aperture cover 126 is typically resiliently deformable. With the snap fit arrangement, the linkage 138 is capable of moving along the channel 130 while movement through the channel 130 is resisted.

Referring to FIG. 15*b*, in some embodiments, the linkage 138 comprises a pinned arrangement, where the linkage 138 is pinned to an internal component of the closure 106. Pinning typically comprises an interference fit, where the base of the linkage 138 is pushed into a hole of comparable, and typically slightly smaller, diameter. With the pinned arrangement, the linkage 138 is capable of moving along the channel 130 of the aperture cover 126 in concert with the internal component to which the linkage 138 is pinned, the internal component of the closure 106 may for example be the first pin 150 and/or the second pin 154 of the second embodiment of the closure 106.

Further fit arrangements may be used in addition to or alternatively to the snap fit and pinned fit arrangements. As an example, it has been described with reference to the second embodiment that pins are used to secure the linkage 138 in the channel 130, where the pins abut the sides of the guide 120 to prevent removal of the linkage from the body 102. In some embodiments, magnetic and/or adhesive connections are used.

Similar mechanisms may also be used as part of the guard attachment 142 and/or to fit any of the pins in any of the holes and/or guides (e.g. to fit the first pin 150 in the guide 120).

Referring to FIGS. 16*a-d*, there is shown various sensors that may be used as part of the activation detector 146 and/or the opening detector 170. The sensors preferably work by contact and/or movement of the sensor. In particular, a sensor may be selected as one or more of the following: a tactile switch, a rotary encoder, a direct electrical contact sensor and/or by non-contact (i.e. distant sensing) in particular a sensor selected amongst any one or more of the following: a photodetector (e.g. photodiode, Light Dependent Resistor sensor, phototransistor, a solaristor, a photovoltaic cell, and/or a bolometer), Infra-Red sensor, accelerometer, inductive sensor or a magnet sensor (e.g. Hall effect sensor). The activation detector 146 and the opening detector 170 may be separate sensors or may be the same sensor, where for example a moveable switch may have three positions relating to the closed position, the open position and the activation position.

In some embodiments, the activation detector 146 and/or the opening detector 170 is capable of determining the position of the closure 106 and/or the time period during which the closure 106 has been in a position. Typically, this comprises determining how long the closure 106 has been in the activation position. After a certain time period (in any position) a signal may be initiated that differs from a signal sent on arrival. As an example, the activation detector 146 may be arranged to detect the arrival of the closure 106 and to initiate a first heating signal on arrival. The activation detector 146 may be further arranged to detect when the closure 106 has been at the activation position for a period of seconds, e.g. 1.5 seconds, and to initiate a second heating signal relating to a reduced heat. Alternatively, the activation detector 146 may be adapted to only initiate an activation signal after the closure 106 has been in the activation position for a certain period of time; this may be used as a safety feature, for example to avoid accidental or absent-minded operation of the heater.

Considering a subset of the sensors shown in FIG. 16, there is shown by order:

Rotary encoder; the movement of the closure 106 rotates a gear and the angular position of the gear is thereby useable to determine the position of the closure 106. Where a rotary encoder is used, the activation position is typically beyond the open position in the direction of movement from the closed position to the open position. This enables the use of a single rotary encoder for detecting each position.

Direct contacts; direct electrical contacts are arranged at one or more of the positions. A current being detected at the contacts indicates that the closure is in that position.

Tactile switch; a tactile switch is depressed when the closure is in one or more of the positions. Using, for example, a rocker switch, the closure 106 being at the open position, closed position, and activation position can be determined using a single tactile switch.

Magnets/Hall effect sensors; magnets and corresponding Hall Effect sensors are arranged on the closure 106 and at one or more of the positions.

LDR (Light Dependent Resistor); an LDR is arranged at one or more positions. A change in the LDR resistance is useable to determine whether it is covered by the closure 106 and hence to determine the position of the closure 106. The LDR may be arranged so that it is uncovered in the open position, partially covered in the closed position, and completely covered in the activation position; this enables a single LDR to be used to determine the position of the closure 106. It will be appreciated that this arrangement could be changed (e.g. so the LDR is uncovered in the activation position and fully covered in the closed position).

Accelerometer; the movement of the closure 106 is determined using an accelerometer; whether the movement is due to the closure 106 opening, closing, or moved to the activation position is determinable by features of the acceleration, e.g. the biasing causes the lid to accelerate towards the open or closed position, but not towards the activation position.

IR motion sensor; the amount of infrared light reflected by the closure 106 depends on the position of the closure.

Inductive sensor; the position of the closure 106 is determined by measuring a current induced in a component of the closure 106 and/or the body 102.

The aerosol generation device 100 typically further comprises a controller (not shown) that is operated by a signal transmitted by the activation detector 146 or the opening sensor 180. Specifically, the controller typically operates a component of the aerosol generation device 100 in dependence on a signal received indicating a position of the closure 106. Typical components that are operated include: a heater; a status indicator; a battery indicator; and a display.

Seventh Embodiment

Figure 17:
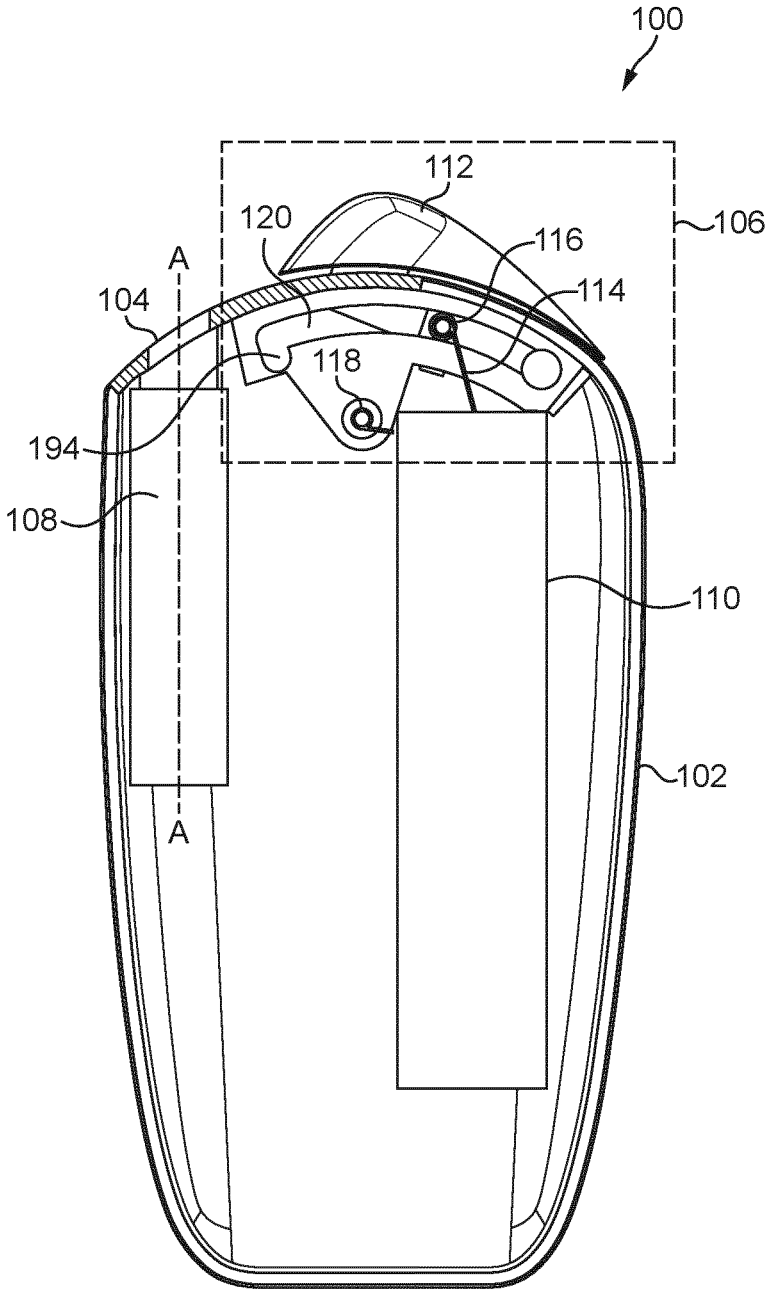
FIG. 17 is a schematic perspective view of a seventh embodiment of an aerosol generation device.

Referring to FIG. 17, an aerosol generation device 100 according to a seventh embodiment of the closure 106 is identical to the aerosol generation device 100 of the first embodiment, described with reference to FIGS. 1 to 5, except that the closure 106 is arranged to be moveable from the closed position to a second activation position.

Specifically, the seventh embodiment comprises a closed activation guide 194, along which the first end 116 of the resilient element 114 is arranged to move when the closure 106 moves between the closed position and the second activation position. Typically, the resilient element 114 is arranged to resist the movement of the closure 106 from the closed position to the second activation position, so that the second activation position is a transitory position. A continuous force is required to hold the closure 106 in place at the second activation position, where the removal of the force results in the resilient element 114 acting to move the closure 106 from the second activation position to the closed position. In some examples, a separate resilient member (not shown) may be provided to bias the closure 106 from the second activation position to the closed position, for example to alter the force required to force the closure 106 into the second activation position.

In some embodiments, the second activation position is a stable position. In these embodiments the first end 116 of the resilient element 114 may be arranged to fit into a recess, e.g. the first end 116 may "click into" and "click out of" the second activation position.

The aerosol generation device 100 is operable to initiate a second activation signal or closed activation position signal when movement of the closure 106 to the second activation position and/or the presence of the closure 106 at the second activation position is detected. The detection typically uses a second activation detector (not shown) that may be one of the types of sensors described with reference to the activation detector 146 or with reference to FIG. 16. In some embodiments, the second activation sensor is the same sensor as the activation detector 146 and/or the opening detector 170.

The second activation signal or closed activation position signal differs from the open activation signal (which has been previously referred to as the activation signal with reference to the first embodiment). The open activation signal is initiated while the aperture 104 is uncovered and may, for example, operate the heater; the second activation signal is initiated while the aperture is covered and may, for example, give an indication of battery or may preheat the chamber using the heater at a reduced power.

In use, to initiate the second activation signal the user exerts a force on the closure 106 to move the first end 116 of the resilient element 114 away from the first position along the closed activation guide 194 to a fourth position relating to the closure 106 being at the closed activation position. This movement deforms the resilient element 114 and is resisted by the resilient element 114. Once the first end 116 of the resilient element 114 reaches the fourth position, e.g. the end of the closed activation guide 194, the closed activation detector is operated and the second activation signal is initiated. This may, for example, result in a battery level being visible to a user.

Once the user removes the force from the closure 106, the force exerted by the resilient element 114 acts to move the first end 116 of the resilient element 114 away from the fourth position along the closed activation guide 194 to the first position and the closure 106 correspondingly moves from the closed activation position to the closed position.

Eighth Embodiment

Figure 18:
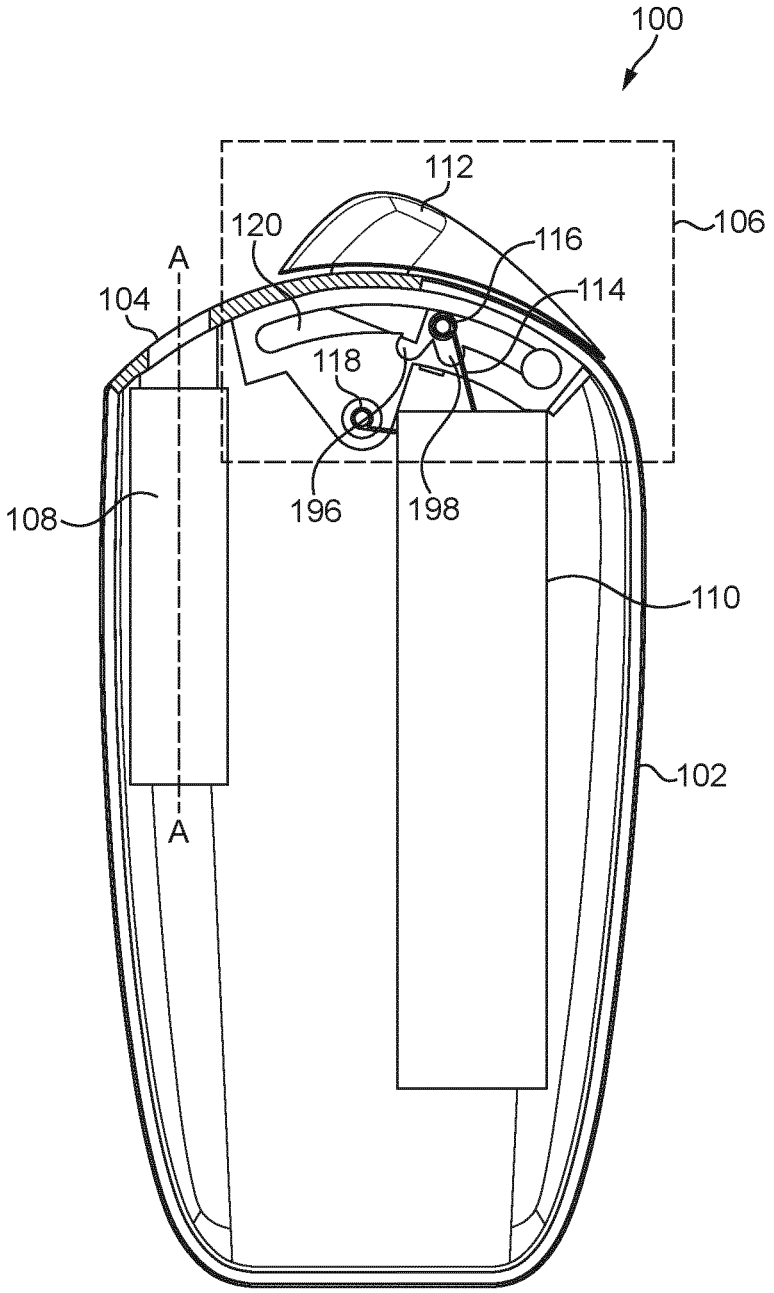
FIG. 18 is a schematic perspective view of an eighth embodiment of an aerosol generation device.

Referring to FIG. 18, an aerosol generation device 100 according to an eighth embodiment of the closure 106 is identical to the aerosol generation device 100 of the first embodiment, described with reference to FIGS. 1 to 5, except that the closure 106 is arranged to be moveable from the open position to a first open activation position and a second open activation position.

Specifically, the eighth embodiment comprises a first open activation guide 196, along which the first end 116 of the resilient element 114 is arranged to move when the closure 106 moves between the open position and the first open activation position and a second open activation guide 198, along which the first end 116 of the resilient element 114 is arranged to move when the closure 106 moves between the open position and the second open activation position. The first end 116 of the resilient element 114 moves along the first open activation guide 196 when the closure is moved away from the open position towards the body 102 of the aerosol generation device 100 and towards the closed position. The first end 116 of the resilient element 114 moves along the second open activation guide 196 when the closure is moved away from the open position towards the body 102 of the aerosol generation device 100 and away from the closed position.

The aerosol generation device 100 is operable to initiate a first or second activation signal when movement of the closure 106 to the first or second open activation position and/or the presence of the closure 106 at the first or second open activation position is detected. The detection typically uses one or more open activation sensors (not shown) that may be one of the types of sensors described with reference to the activation detector 146 or with reference to FIG. 16.

The first open activation signal differs from the second open activation signal. As an example, the first open activation signal and the second open activation signal may each operate the heater at different powers, so that each open activation signal may be appropriate for different types of aerosol substrates. The first open activation signal and the second open activation signal may each initiate other operations, such as checking a battery level, checking a heater temperature, or monitoring a use time.

In use, the user exerts a force on the closure 106 to move the closure towards the body and either towards or away from the closed position. Depending on the direction of the force exerted by the user, the first end 116 of the resilient element 114 moves away from the second position along either the first open activation guide 196 or the second open activation guide 198. This movement deforms the resilient element 114 and is resisted by the resilient element 114—the degree of resistance differs depending on the guide along which the resilient element 114 is moved. Once the first end 116 of the resilient element 118 reaches the end of either of the open activation guides 196, 198, an activation sensor is operated and an activation signal is initiated. The activation signal initiated depends on along which of the opening activation guides 196, 198 the first end has been moved.

Once the user removes the force from the closure 106, the force exerted by the resilient element 114 acts to move the first end 116 of the resilient element 114 away from the end of the selected open activation guide to the second position and the closure 106 correspondingly moves from the chosen open activation position to the open position.

More generally, it will be appreciated that any number of activation positions may be provided in any combination, optionally each with a motion regulated by the resilient element 114 and/or a respective resilient element. As another example, there may be any plurality of differing activation positions accessible from the open position, where a first open activation position of the plurality of activation positions is reached by moving the closure 106 away from the open position transverse to the body 102 of the aerosol generation device 100 and a second open activation position is reached by moving the closure away from the open position towards the body 102 of the aerosol generation device 100. Similarly, a plurality of closed activation positions may be provided. Moving to any of the activation positions may involve deforming the resilient element 114, where the magnitude and direction of the deformation of the resilient element 114 depends on the direction of movement of the closure 106; therefore, a different force may be required to move to each activation position. This is useable to provide greater resistance to, for example, more power intensive operations (e.g. accessing an activation position for operating a heater may require greater force than accessing an activation position for checking a battery level).

In some embodiments, the closure 106 is moveable to one or more further activation positions from the activation position, as an example the aerosol generation device 100 may comprise a first and a second activation position where the closure is moveable from the open position to the first activation position and from the first activation position to the second activation position. The directions of movement between the open position and the first activation position and the first activation position and the second activation position may differ, so that the closure 106 may, for example, be moved towards the body 102 to reach the first activation position and then transverse to the body 102 to reach the second activation position.

Ninth Embodiment

Figure 19:
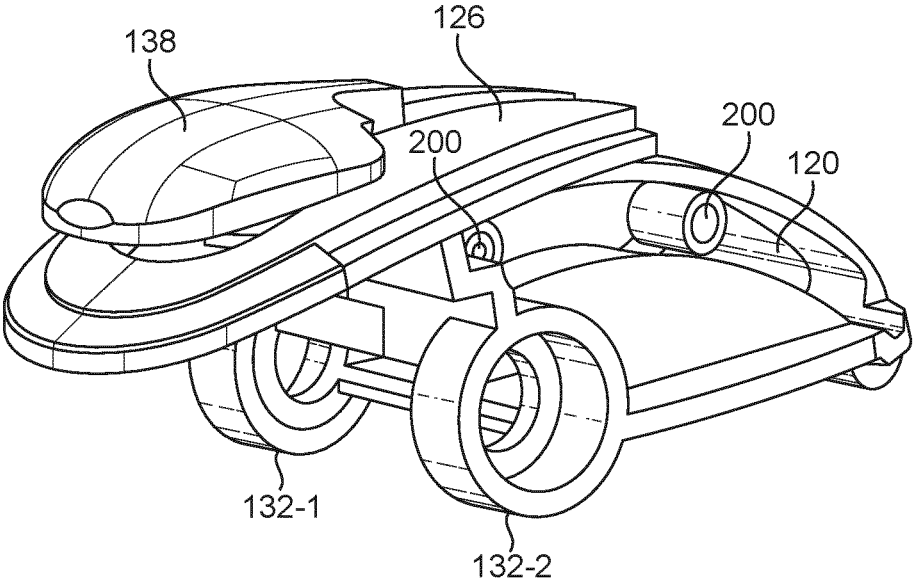
FIG. 19 is a schematic perspective view of a ninth embodiment of an aerosol generation device.
Figure 19:
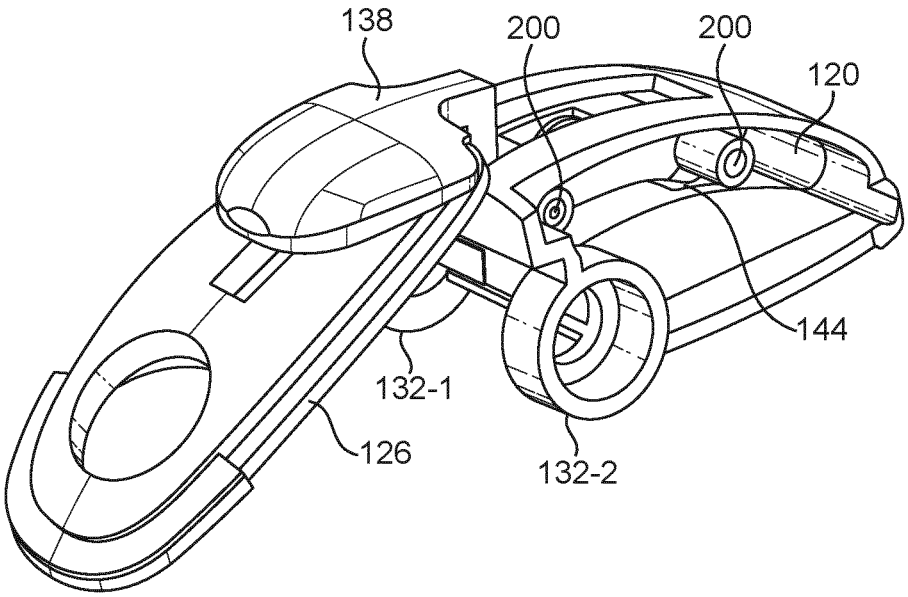

Referring to FIG. 19, an aerosol generation device 100 according to a ninth embodiment of the closure 106 is identical to the aerosol generation device 100 of the third embodiment, described with reference to FIG. 8, except that the activation detector 146 of the ninth embodiment differs from that of the third embodiment; the activation detector 146 of the ninth embodiment is depressed by the linkage 138. More specifically, the guard attachment 142 of the ninth embodiment is arranged so as to depress the activation detector 146 when the user pushes on the external cover 112 of the closure 106.

Further, the linkage 138 comprises at least one protrusion 200 that is arranged to move along the guide 120 once the closure 106 is assembled; in this embodiment, the linkage comprises four protrusions 200. The protrusions 200 replace the movement pin 136 of the first embodiment and reduce the number of components required to form the closure 106.

Further the guide component 132 of the ninth embodiment comprises a first guide component part 132-1 and a second guide component part 132-2; the two components are arranged to fit together to form the guide element 132; this enables the two guide component parts 132-1 and 132-2 to be fit around the linkage 138 enable simple assembly.

Figure 20:
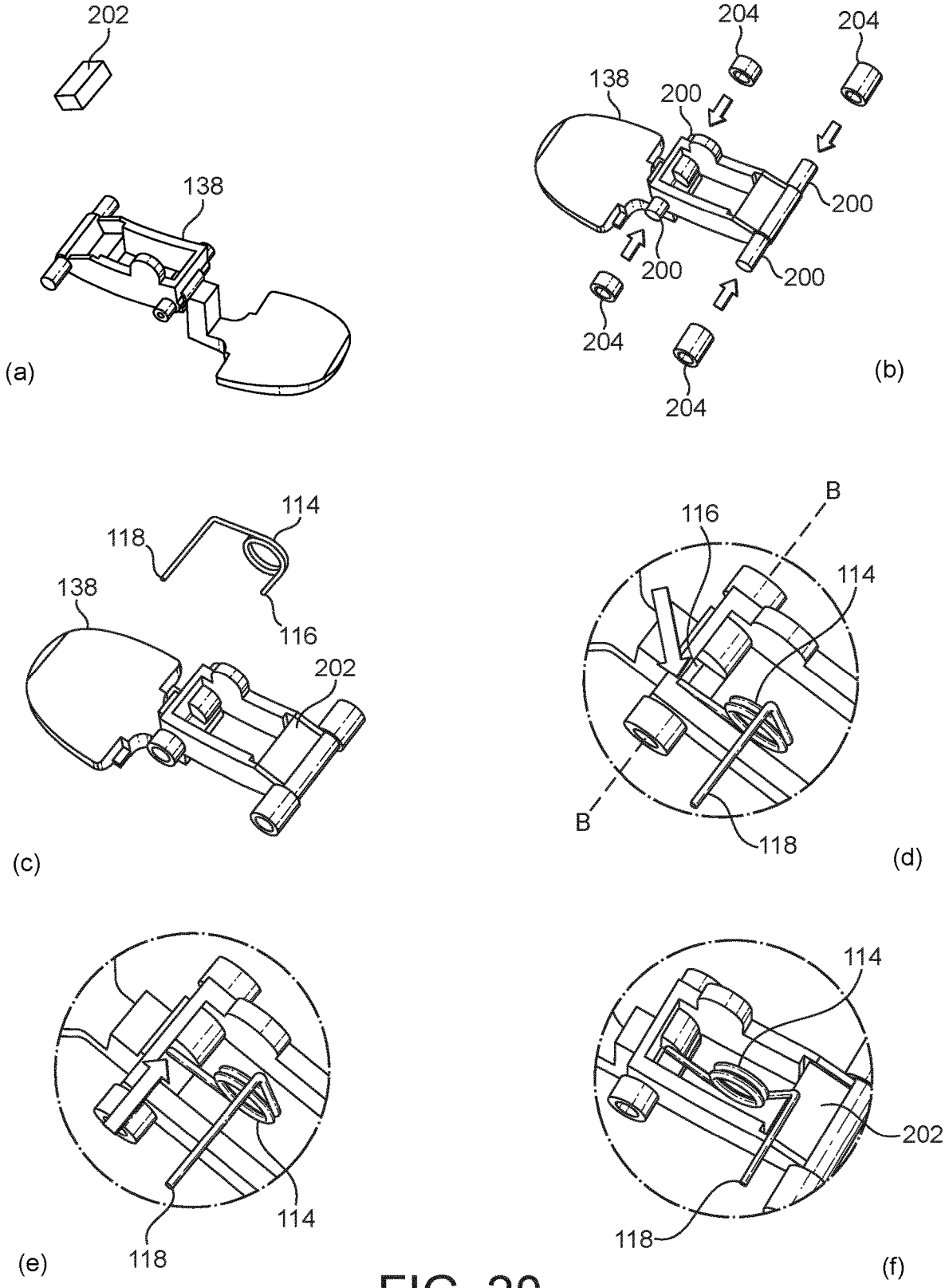
FIGS. 20 to 23 are component views of the closure of the ninth embodiment of the closure in various stages of assembly.
Figure 21:
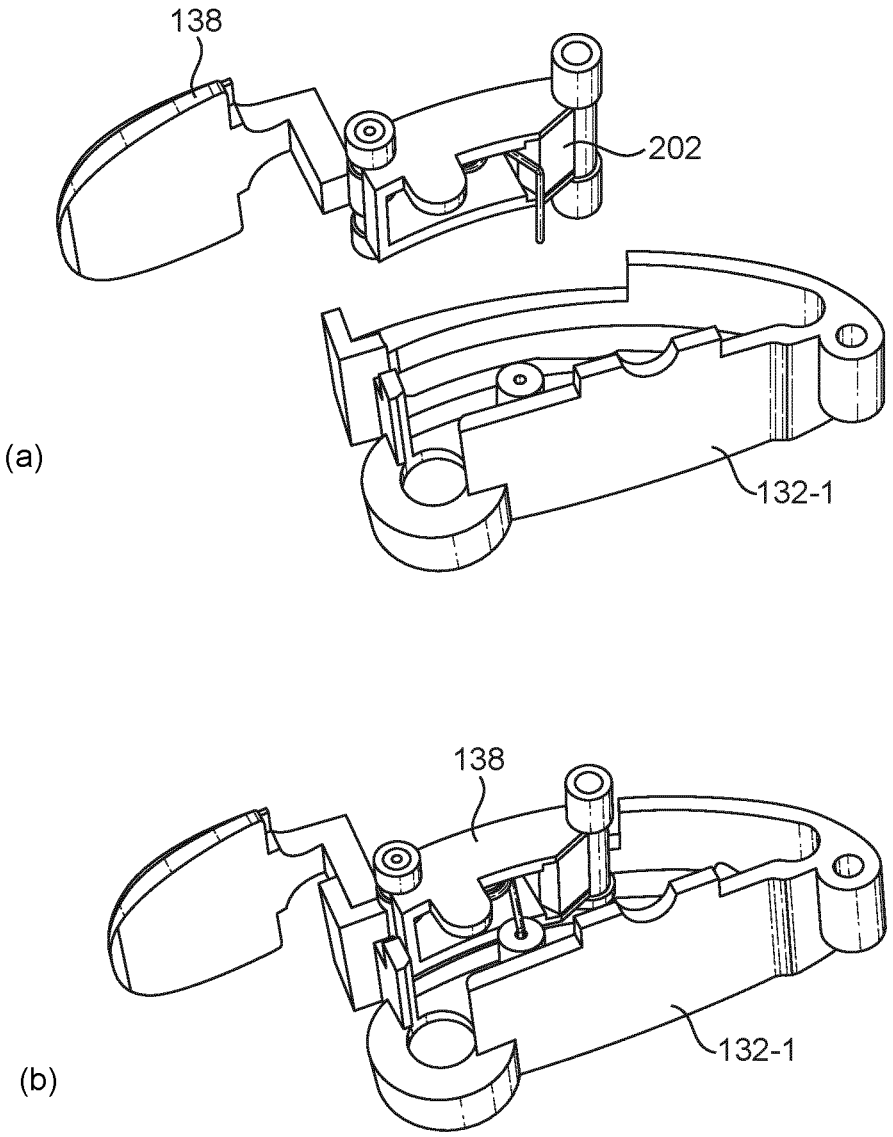
Figure 22:
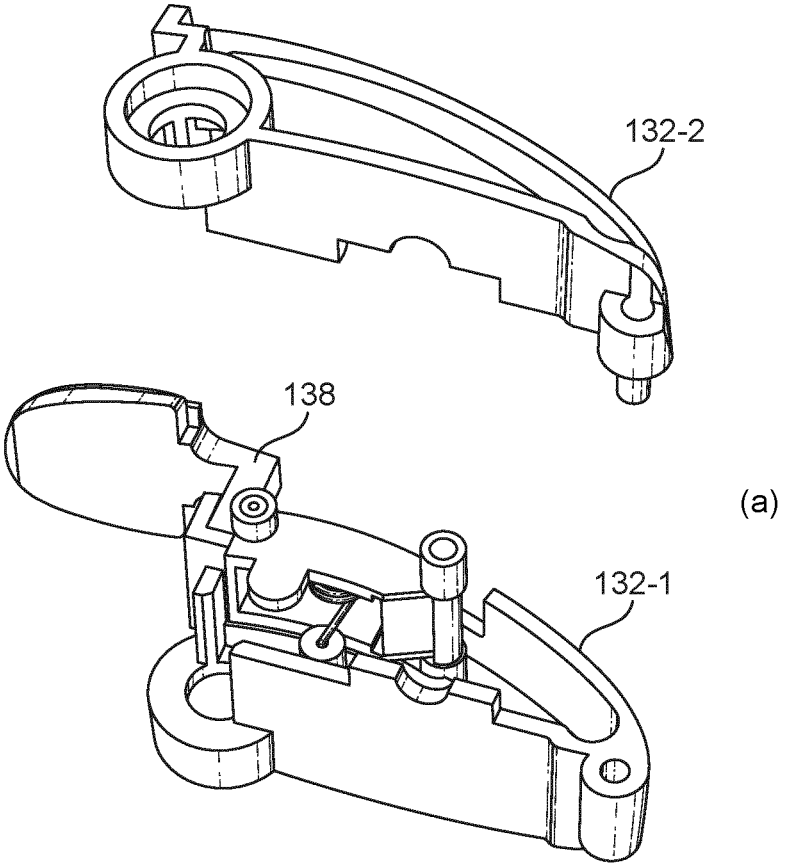
Figure 22:
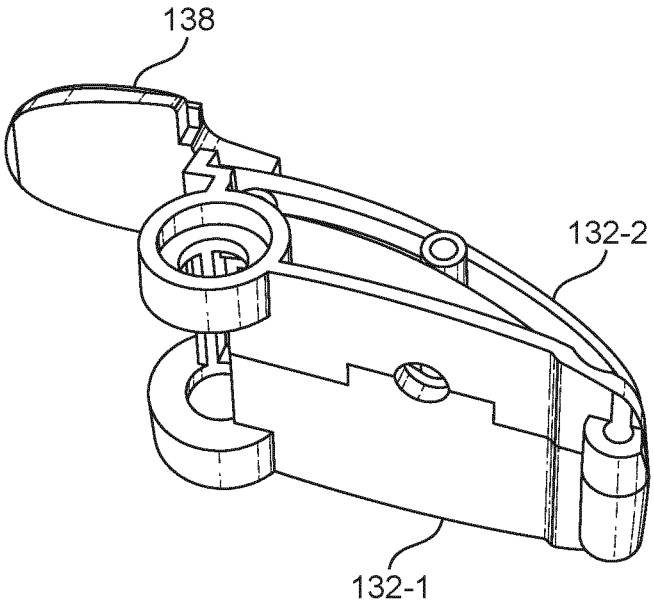

Referring to FIGS. 20 to 22, the components of the ninth embodiment of the closure 106 and a method of constructing the ninth embodiment of the closure 106 are shown.

FIG. 20(*a*) shows the linkage 138 and a magnet 202; the magnet 202 is arranged to fit into the linkage 138 and to hold the resilient element 114 in place during construction of the closure 106.

FIG. 20(*b*) shows the linkage 138 with the magnet 202 inserted in the linkage 138. FIG. 20(*b*) further shows a plurality of pin bearings 204, which are arranged so as to be mountable on the integral movement pins 200 of the linkage 138; the pin bearings 204 ensure smooth movement of the linkage 138 along the guide 120.

FIG. 20(*c*) shows the linkage 138 with the pin bearings 204 mounted on the integral movement pins 200. FIG. 20(*c*) further shows the resilient element 114.

The linkage 138 comprises an integral first end holder 206; the first end 116 of the resilient element 114 is sized to fit inside a cavity defined by the first end holder 206.

FIGS. 20(*d*) and 20(*e*) show the first end 116 of the resilient element 114 being inserted into the first end holder 206. In practice, the first end 116 of the resilient element 114 is moved directly towards the first end holder 206 perpendicular to an axis B-B of the first end holder 206; once the first end 116 of the resilient element 114 lines up with a hole of the first end holder, that is once the first end 116 is on the axis B-B, the first end 116 of the resilient element 114 is moved along the axis B-B of the first end holder 206.

FIG. 20(*f*) shows the assembled linkage. The first end 116 of the resilient element 114 is mounted to the linkage 106 by being held in the first end holder 206; the resilient element 114 is further retained in the linkage 138 by being held by the magnet 202 so that the second end 118 of the resilient element 114 can be easily located in a holder.

Referring to FIGS. 21(*a*) and (*b*), the linkage is inserted into first guide component part 132-1; specifically the protrusions 200 on one side of the linkage 138 are inserted into the guide section on the first guide component part 132-1. The first guide component 132-1 comprises a second end holder 208; the second end 118 of the resilient element 114 is sized to fit inside a cavity defined by the second end holder 208. During construction, the second end 118 of the resilient element 114 is inserted into the second end holder 208 of the first guide component part 132-1.

The first end 116 of the resilient element 114 is mounted to the linkage 138; the second end 118 of the resilient element 114 is mounted to the first guide component 132-1; hence as the linkage 138 moves relative to the first guide component 132-1 by the protrusions 200 moving along the guide 120 of the guide component 132, the resilient element 114 deforms.

FIGS. 22(*a*) and (*b*) show the second guide component parts 132-2 being fitted onto the first guide component part 132-1. The first and second guide component parts 132-1, 132-2 and the linkage 138 are sized so that when the second guide element 132-2 is fitted onto the first guide component part 132-1, the protrusions 200 of the linkage 138 are located in the guide sections of the first guide component part 132-1 and the second guide component part 132-2. The linkage 138 is thus held in place by the components of the guide component part 132.

In various embodiments, the first and second guide component part 132-2 are secured together using an interference fit, a snap fit, and/or an adhesive means, such as screws or a chemical adhesive.

Figure 23:
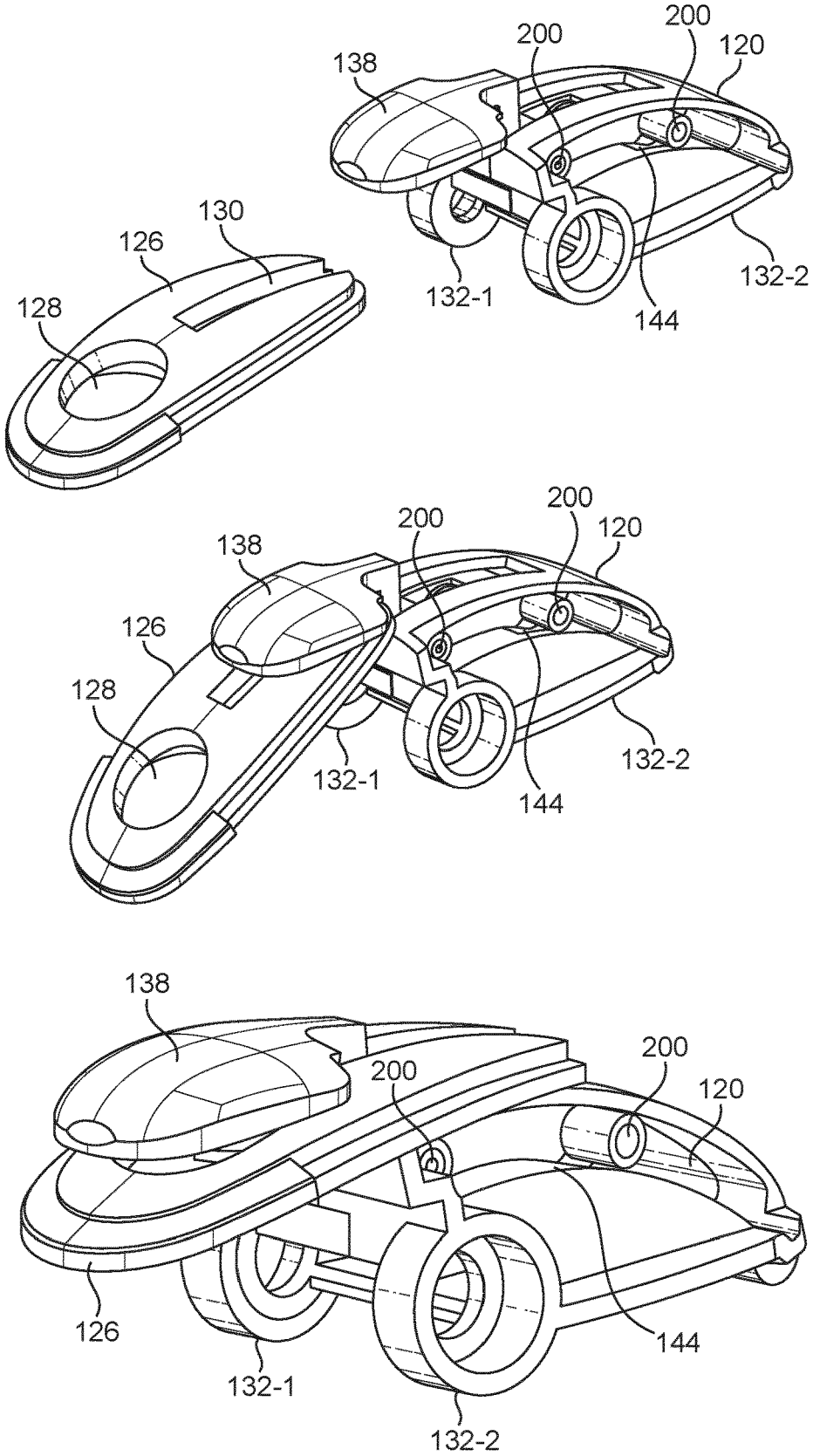

Referring to FIG. 23, once the guide component part 132 has been assembled around the linkage 138, the aperture cover 126 is placed between the linkage 138 and the guide element 132. Typically, this comprises the body of the linkage 138 being aligned with the channel 130 of the aperture cover 126 and the aperture cover 126 then being moved along the linkage 138 until the cover aperture 128 overlaps with the aperture 104.

Further components, such as the external cover 112, may then be mounted on the linkage 138.

The constructed closure 106 is then placed into the body 102 of the aerosol generation device 100.

In use, the user placing a force on the external cover 112 transfers a force to the linkage 138. As the user exerts a force to move the closure 106 away from the closed position, the protrusions 200 of the linkage move along the guide 120 of the guide element until the closure 106 reaches the open position. In the open position, the distal protrusions 200 (distal relative to the aperture 104) abut the end of the guide 120 of the guide element 132.

Once the closure 106 is in the open position, the user exerts downward pressure on the external cover 112 of the closure 106, which results in the proximal protrusions 200 of the linkage 138 moving along the sensor guide 144; this causes the linkage to rotate about the distal protrusions 200 which are held in place by the edges of the guide 120. As the proximal protrusions 200 move along the sensor guide 144, the guard attachment 142 of the linkage depresses the activation detector 146, which initiates an activation signal.

Definitions and Alternative Embodiments

It will be appreciated from the description above that many features of the different embodiments are interchangeable with one another. The disclosure extends to further embodiments comprising features from different embodiments combined together in ways not specifically mentioned.

While the detailed description has primarily considered the use of a resilient element 114 that is compressed as the first end 116 of the resilient element 114 moves along the guide 120; it will be appreciated that the resilient element 114 may also be arranged to extend as the first end 116 of the resilient element 114 moves along the guide 120. In these embodiments, the extensive force is similarly arranged to return the first end 116 towards the closed position from the first range of positions and toward the open position from the second range of positions so that the closure 106 remains stable in either the closed position or the open position. As opposed to a compressive arrangement, the use of an extensive arrangement typically leads to the first end of the resilient element 114 being forced towards a side of the guide 120 that is nearer to the body 102. While with a compressive arrangement the closure 106 is typically forced against the hand of the user moving the closure 106, with an extensive arrangement the closure 106 is typically forced away from the hand of the user moving the closure 106.

While the detailed description has primarily considered the first end 116 of the resilient element 114 moving along the guide 120, it will be appreciated that the first end 116 may also be attached to, or may interact with, another element that moves along the guide 120—and this is the case in a subset of the considered embodiments. Considering, for example, the second embodiment, the first end 116 of the resilient element 114 does not move along the guide 120, rather it is attached to the linkage 138, which comprises pins 150, 154 that move along the guide 120. In this manner, even though the first end 116 of the resilient element 114 does not move along the guide 120, it does move along a guide by dint of its attachment to components that do move along the guide 120. Further, while the first end 116 may not be in direct contact with the side of the guide 120, the pins 150 and 154 are in contact with the side of the guide 120, and the force of the resilient element 114 is therefore indirectly transferred to the side of the guide 120.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. An aerosol generation device comprising:

a body having an aperture through which an aerosol substrate is receivable into the aerosol generation device;

a closure moveable relative to the aperture between a closed position in which the closure covers the aperture and an open position in which the aperture is substantially unobstructed by the closure; and a resilient element arranged so as to bias the closure towards the closed position from a first range of positions between the closed position and the open position and to bias the closure towards the open position from a second range of positions between the closed position and the open position, the first range of positions of the closure being closer to the closed position than the second range of positions and the second range of positions of the closure being closer to the open position than the first range of positions, a first end of the resilient element being arranged to cooperate with the closure so as to move in a first direction between a first position when the closure is in the closed position and a second position when the closure is in the open position, the resilient element being oriented to deform in a second direction transverse to the first direction, towards and/or away from the body relative to the closure to provide biasing as the first end of the resilient element moves between the first position and the second position.

2. The aerosol generation device of claim 1, wherein the first range of positions is substantially adjacent to the second range of positions.

3. The aerosol generation device of claim 1, wherein the resilient element is arranged to resist movement of the closure away from the closed position.

4. The aerosol generation device of claim 3, wherein the resilient element is arranged to resist movement of the closure away from the closed position when the closure is in the first range of positions.

5. The aerosol generation device of claim 1, wherein the resilient element is arranged to resist movement of the closure away from the open position.

6. The aerosol generation device of claim 5, wherein the resilient element is arranged to resist movement of the closure away from the open position when the closure is in the second range of positions.

7. The aerosol generation device of claim 1, wherein the closure is stable in each of the closed position and the open position.

8. The aerosol generation device of claim 1, wherein the resilient element is arranged so as to provide a biasing force resisting movement away from the closed position when the first end of the resilient element is at the first position and the resilient element is arranged so as to provide a biasing force resisting movement away from the open position when the first end of the resilient element is at the second position.

9. The aerosol generation device of claim 1, wherein the resilient element is a spring.

10. The aerosol generation device of claim 1, further comprising a guide, wherein the first end of the resilient element is arranged to move along the guide between the first position and the second position.

11. The aerosol generation device of claim 10, wherein the guide has an arc-shaped guiding or linear path.

12. The aerosol generation device of claim 10, wherein the resilient element is arranged so as to bias the first end of the resilient element towards a side of the guide, wherein the side is a side either furthest from or closest to the closure.

13. The aerosol generation device of claim 1, wherein the resilient element is arranged so as to force the first end of the resilient element directly towards the closure away from the body.

14. The aerosol generation device of claim 1, wherein the resilient element is arranged so as to force the first end of the resilient element directly away from the closure towards the body.

15. The aerosol generation device of claim 1, wherein a direction of movement of the closure from the closed position to the open position is towards or away from the body.

16. The aerosol generation device of claim 1, wherein the resilient element is arranged so as to maximally deform when the first end of the resilient element is midway between the first position and the second position, or when the first end of the resilient element is at a position offset from midway between the first position and the second position.

17. The aerosol generation device of claim 1, wherein the closure is further moveable to an activation position at which the aerosol generation device is operable to initiate an activation signal.

18. The aerosol generation device of claim 17, wherein the closure is further moveable to a further activation position at which the device is operable to initiate a further activation signal.

19. The aerosol generation device of claim 17, wherein the aerosol generation device further comprises an activation detector arranged so as to detect a position of the closure and/or a movement of the closure in order to initiate the activation signal.

20. The aerosol generation device of claim 1, wherein the resilient element being oriented to deform comprises the resilient element being arranged so as to compress or to extend.

* * * * *